US008517469B1

(12) United States Patent
Hetzel et al.

(10) Patent No.: US 8,517,469 B1
(45) Date of Patent: Aug. 27, 2013

(54) THREE-AXIS ADJUSTABLE BACK SUPPORT ASSEMBLY AND METHOD

(75) Inventors: Thomas R. Hetzel, Littleton, CO (US); Joseph S. Bieganek, Littleton, CO (US); Rex W. Stevens, Longmont, CO (US); Eric H. Vielbig, Boulder, CO (US)

(73) Assignee: Aspen Seating, LLC, Sheridan, CO (US)

( * ) Notice: Subject to any disclaimer, the term of this patent is extended or adjusted under 35 U.S.C. 154(b) by 0 days.

(21) Appl. No.: 13/605,638

(22) Filed: Sep. 6, 2012

(51) Int. Cl.
*A47C 7/46* (2006.01)

(52) U.S. Cl.
USPC ..... 297/284.4; 280/250.1; 297/440.2; 297/16.1

(58) Field of Classification Search
USPC ..... 280/304.1, 250.1; 297/16.1, 230.11, 297/230.14, 284.4–284.8, 285, 301.6, 440.2, 297/353
See application file for complete search history.

(56) References Cited

U.S. PATENT DOCUMENTS

| | | | | |
|---|---|---|---|---|
| 2,043,433 | A | 6/1936 | Gabb | |
| 3,497,259 | A | 2/1970 | Sherfey | |
| 3,730,589 | A | 5/1973 | Lane | |
| 4,615,856 | A | 10/1986 | Silverman | |
| 4,678,230 | A | 7/1987 | Winkle | |
| 4,883,320 | A | 11/1989 | Izumida et al. | |
| 4,925,242 | A * | 5/1990 | Harris et al. | 297/284.4 |
| 5,228,747 | A | 7/1993 | Greene | |
| 5,344,211 | A | 9/1994 | Adat et al. | |
| 5,364,162 | A | 11/1994 | Bar et al. | |
| 5,547,251 | A * | 8/1996 | Axelson | 297/284.5 |
| 5,556,168 | A | 9/1996 | Dinsmoor, III et al. | |
| 5,593,211 | A | 1/1997 | Jay et al. | |
| 6,095,611 | A * | 8/2000 | Bar et al. | 297/440.21 |
| 6,158,810 | A * | 12/2000 | Galloway | 297/354.1 |
| 6,186,594 | B1 | 2/2001 | Valiquette et al. | |
| 6,257,664 | B1 | 7/2001 | Chew et al. | |
| 6,460,927 | B1 | 10/2002 | Groth | |
| 6,460,933 | B1 | 10/2002 | Bors et al. | |
| 6,659,563 | B2 | 12/2003 | Float et al. | |
| 6,688,693 | B2 | 2/2004 | Christofferson et al. | |
| 6,733,074 | B2 | 5/2004 | Groth | |
| 7,104,610 | B2 | 9/2006 | Cramer | |
| 7,216,388 | B2 | 5/2007 | Bieganek et al. | |
| 7,448,684 | B2 | 11/2008 | Hsiao | |

(Continued)

FOREIGN PATENT DOCUMENTS

| | | | |
|---|---|---|---|
| EP | 1 354 538 | B1 | 5/2006 |
| WO | 99/17636 | A1 | 4/1999 |
| WO | 2009/084961 | A1 | 7/2009 |

OTHER PUBLICATIONS

PCT International Search Report with attached Written Opinion of the International Searching Authority for International Application No. PCT/US2012/027018, dated Jun. 4, 2012, 8 pages.

(Continued)

*Primary Examiner* — Tashiana Adams
(74) *Attorney, Agent, or Firm* — John R. Ley

(57) ABSTRACT

The back of a wheelchair user is independently supported along and about three mutually perpendicular axes. Two elongated adjustment arms are pivotally connected to extension arms which telescope into opposite ends of a hollow connecting tube. The support positions along and about the three axes is achieved by pivoting the arms and the connected relationships of a back shell and cushion to the connecting tube, while the adjustment arms remain pivotally connected to the wheelchair and the extension arms are telescopically retained in the connecting tube.

37 Claims, 23 Drawing Sheets

(56) References Cited

U.S. PATENT DOCUMENTS

| | | | | |
|---|---|---|---|---|
| 7,854,481 | B2 | 12/2010 | Fraser | |
| 7,857,394 | B2 | 12/2010 | Whelan et al. | |
| 7,891,739 | B2 | 2/2011 | Cramer | |
| 7,980,580 | B2 | 7/2011 | Loewenthal et al. | |
| 8,070,232 | B2 | 12/2011 | Hung | |
| 8,197,009 | B2 | 6/2012 | Whelan et al. | |
| 2003/0052525 | A1 | 3/2003 | Bors et al. | |
| 2003/0102706 | A1* | 6/2003 | Float et al. | 297/440.2 |
| 2005/0275272 | A1 | 12/2005 | Fraser | |
| 2008/0157581 | A1 | 7/2008 | Whelan et al. | |
| 2009/0072105 | A1* | 3/2009 | Cramer | 248/226.11 |
| 2010/0276974 | A1* | 11/2010 | Huttenhuis | 297/284.3 |
| 2011/0080031 | A1* | 4/2011 | Whelan et al. | 297/440.2 |
| 2012/0091300 | A1 | 4/2012 | Bee et al. | |
| 2012/0223560 | A1* | 9/2012 | Hetzel et al. | 297/285 |

OTHER PUBLICATIONS

U.S. Appl. No. 13/039,051, titled "Back Support, Orientation Mechanism and Method," filed Mar. 2, 2011, Publication No. 2012/0223560, publication date Sep. 6, 2012.

* cited by examiner

THREE-AXIS ADJUSTABLE BACK SUPPORT ASSEMBLY AND METHOD

This invention relates to seating and support devices for effectively supporting a person in a wheelchair. More particularly, the present invention relates to a new and improved adjustable back support assembly and method which allows a physical therapist or a wheelchair seating professional to establish the most effective and safe position for supporting the back and upper torso of an individual seated in a wheelchair, along and about three mutually perpendicular axes, in an efficient and effective manner.

BACKGROUND OF THE INVENTION

It is particularly important to wheelchair users who have physical disabilities and associated posture and postural control impairments, such as those typically caused by congenital disorders, to achieve an optimal seating and support position on the wheelchair. It is equally important to do the same for wheelchair users who have a more typical size and shape but have been disabled by acquired or traumatic injuries or debilitating disease. These individuals spend most of their waking hours residing in a wheelchair. Obtaining individualized support and alignment of the wheelchair user is important for optimal mobility, function, health and safety. Without achieving the proper and safe posture, the wheelchair user may be susceptible to further deterioration in physical capabilities, due to progression of postural deformity and associated deterioration of health and mobility as well as increased risk for pressure ulcers induced from sitting.

To achieve the correct postural alignment of the user in the wheelchair, it is necessary to locate and support the seat cushion and the back cushion in an individualized manner according to the posture and physiology of the wheelchair user. In the case of the seat cushion, much of the support arises from the contour of the cushion. Positioning the back cushion is usually considerably more complex, because more adjustments are required. The back and upper torso of the wheelchair user must usually be positioned relative to the seat cushion, to achieve balance on the wheelchair so the user does not experience a tendency to fall or lean forward, backward or sideways. In some circumstances, the physiology of the back and upper torso of the wheelchair user is complex in shape, requiring more support than with a more typical physiology.

These complexities in back support have led to the recognition that a maximum amount of adjustment capability is desirable. In general, that maximum amount of adjustment requires adjustments along and about the three mutually perpendicular longitudinal, transverse and vertical axes. The capability to make adjustments in each of these six realms of possible movement (longitudinal and pivotal moment along and about the three mutually perpendicular axes), assures maximum flexibility in achieving the optimum position for support and the most healthy outcome.

A number of back support devices have been developed which provide longitudinal and pivotal movement in one or all of the three mutually perpendicular axes. Those back support devices which provide longitudinal and pivotal movement in all three mutually perpendicular axes are usually the most desirable for use. However, the prior three-axis longitudinal and pivotal movement back support devices are very complex in construction, with many moving parts having complex interdependent relationships and positions, which a physical therapist or wheelchair seating professional may not fully appreciate or fully utilize when fitting the back support device to the wheelchair user. Furthermore, adjustments can be achieved only with great difficulty and effort, due to the mechanical complexity of the device. In many cases, the positioning on or about one axis is so interdependent with the positioning on or about one or both of the other two axes that an adjustment along or about one axis creates the undesirable effect of changing the position on or about one or more of the other two axes, making it extremely difficult and time-consuming for the fitting therapist or seating professional to achieve optimal support and positioning. The complexity of the device complicates the effort, since many physical therapists and wheelchair seating professionals have difficulty understanding the mechanical relationships involved in adjusting the numerous elements. Adjustments are also complicated by the necessity to insert separate shims and adjustment elements into the mechanical structure, and the necessity to disassemble parts to make adjustments. Losing or misplacing parts is constant risk, and the back support device cannot be used until replacement parts are obtained.

The complexity of prior mechanical back support devices also frequently leads to loss of the optimal position, because the nature of the mechanical devices make them susceptible to slip from the initial adjusted position. The mechanical features of prior back support devices also cause them to feel or to be perceived as loose in assembly or connection to the wheelchair. Such a feeling is extremely disconcerting to the security of a wheelchair user, since the user usually depends on the mechanical integrity of the support device when controlling the wheelchair and to prevent falls from the wheelchair. Many prior back support devices are also heavy, which adds to the effort of maneuvering the wheelchair. Many prior back support devices are not aesthetically pleasing in appearance, which also detracts from the persona or self-image of the wheelchair user.

BRIEF SUMMARY OF THE INVENTION

This invention is for an apparatus and method which permits longitudinal and pivotal adjustment of a back support for the back and upper torso of a wheelchair user along and about the three mutually perpendicular axes. The longitudinal and pivotal adjustment along and about each of the three mutually perpendicular axes is accomplished independently of the adjustment about the other two mutually perpendicular axes. However, for purposes of initial positioning, the back support apparatus allows movement along and about all three mutually perpendicular axes simultaneously to obtain an initial adjustment position. Once the initial adjustment position is established, individual fine adjustment in each of the six realms of movement is achieved without disturbing or otherwise adversely influencing the individual adjustments in the other five realms of movement.

All of the adjustments can be made without disassembling any parts, without adding extra parts, and without risking that some of the parts will become unintentionally disassembled during adjustment. The components of the back support apparatus are rigidly and tightly coupled together, creating a strong, light-weight and aesthetically-pleasing structure that imparts a feeling of security and enhanced persona or self-image in the wheelchair user. The components of the back support apparatus connect together in a way which makes it extremely unlikely that the apparatus will lose its adjustment from use. The components of the back support apparatus are minimal in their number and straightforward in their interaction with one another, which makes the apparatus easier to understand, set up, adjust and use, all of which facilitates achieving optimal back support for the wheelchair user.

These and other features are achieved in a new and improved back support assembly for connection to canes of a wheelchair by which to support a back shell and back cushion against the a back and upper torso of a wheelchair user, and in a new and improved method of supporting a back and upper torso of a wheelchair user along and about three mutually perpendicular longitudinal, transverse and vertical axes by a back cushion connected to a back shell connected to a wheelchair.

The back support assembly comprises a pair of mounting devices adapted for connection to the wheelchair. A pair of adjustment arms each have first and second opposite ends. The first ends of the adjustment arms pivotally connect respectively to the mounting devices. A pair of extension arms each have first and second opposite ends. The first ends of the extension arms are connected respectively to the second ends of the adjustment arms to selectively pivot the extension arms relative to the adjustment arms and to rigidly maintain a selected pivotal position of each extension arm relative to the connected adjustment arm. The second end of each extension arm has a predetermined cross-sectional configuration. A connecting structure has opposite ends with openings into which the second ends of the extension arms are respectively inserted to telescope relative to the connecting structure. Each opening in the connecting structure has a complementary predetermined cross-sectional configuration corresponding to the predetermined cross-sectional configuration of the second ends of each extension arm which are inserted into that opening. A back retaining clamp is connected to the connecting structure to pivot or rotate selectively about the connecting structure. A back shell connector is connected to the back retaining clamp to move selectively vertically relative to the connecting structure. The back shell connector is adapted to connect to the back shell in a selected relative rotational position relative to the connecting structure. This single apparatus allows adjustment of the back shell and back cushion selectively and independently along and about all three mutually perpendicular axes without disconnecting any parts and while overcoming the disadvantages of the known prior art back support devices.

The method involves operatively and pivotally connecting first ends of two elongated adjustment arms to wheelchair back canes on respectively opposite transverse sides of the wheelchair frame, pivotally connecting first ends of elongated extension arms to second ends of the adjustment arms, telescopically extending second ends of the extension arms into opposite ends of a connecting structure, and operatively attaching the back shell to the connecting structure. The longitudinal position of the back cushion is adjusted along the longitudinal axis and the pivotal position of the back cushion is adjusted about the vertical axis by selectively establishing and fixing pivoted positions of the adjustment and extension arms relative to one another. The transverse position of the back cushion along the transverse axis is adjusted by either telescopically moving the connecting structure relative to the second ends of the extension arms and by positioning the back shell at a selected transverse position along the connecting structure. The pivoted position of the back cushion about the transverse axis is adjusted by selectively pivoting the back shell about the transverse axis relative to the connecting structure at the operative attachment of the back shell to the connecting structure. The vertical position of the back cushion is adjusted along the vertical axis by selectively positioning the back shell at a selected position along the vertical axis relative to the connecting structure at the operative attachment of the back shell to the connecting structure. The pivoted position of the back cushion about the longitudinal axis is adjusted by selectively pivoting the position the back shell about the longitudinal axis at the operative attachment of the back shell to the connecting structure. All of these adjustments are performed while the first ends of the adjustment arms remain operatively pivotally connected to the canes and while the second ends of the extension arms remain inserted in the connecting structure.

Many other more specific and subsidiary details of the structure and methodology of the present invention are described in the appended claims and can be better appreciated by reference to the following detailed description of presently preferred embodiments and the accompanying drawings, which are briefly summarized below.

DETAILED DESCRIPTION

Figure 1:
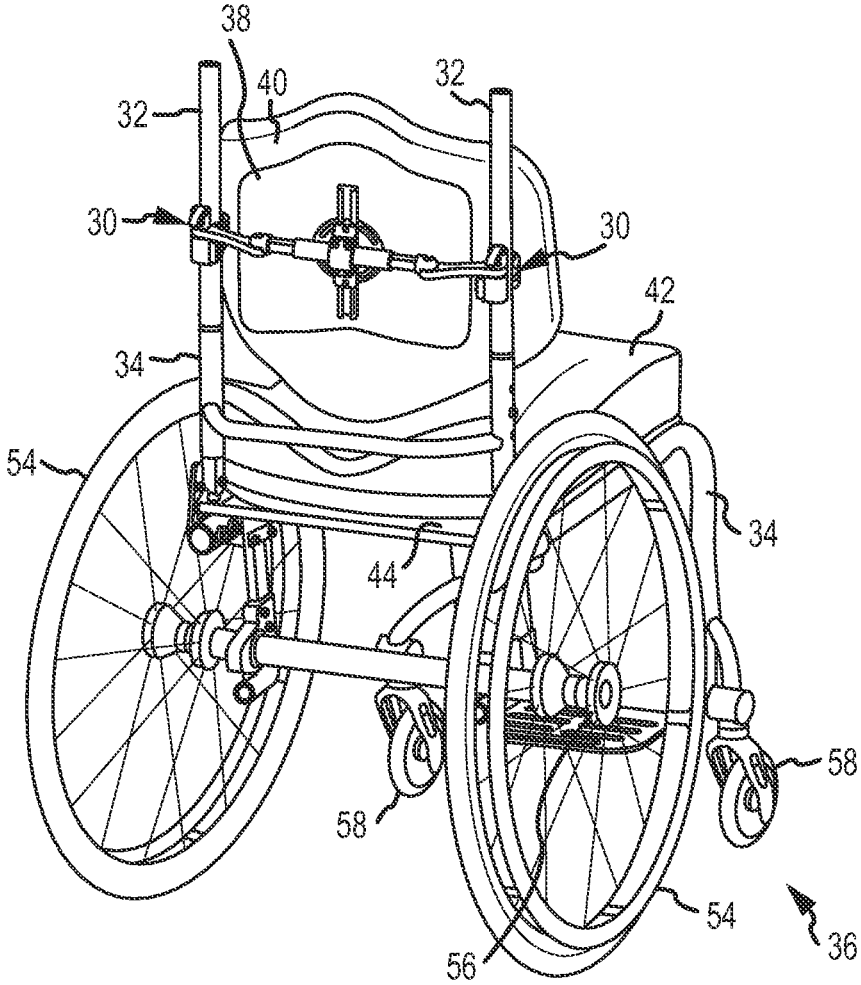
FIG. 1 is a rear perspective view of a wheelchair with an attached three-axis adjustable back support assembly which incorporates the present invention.
Figure 2:
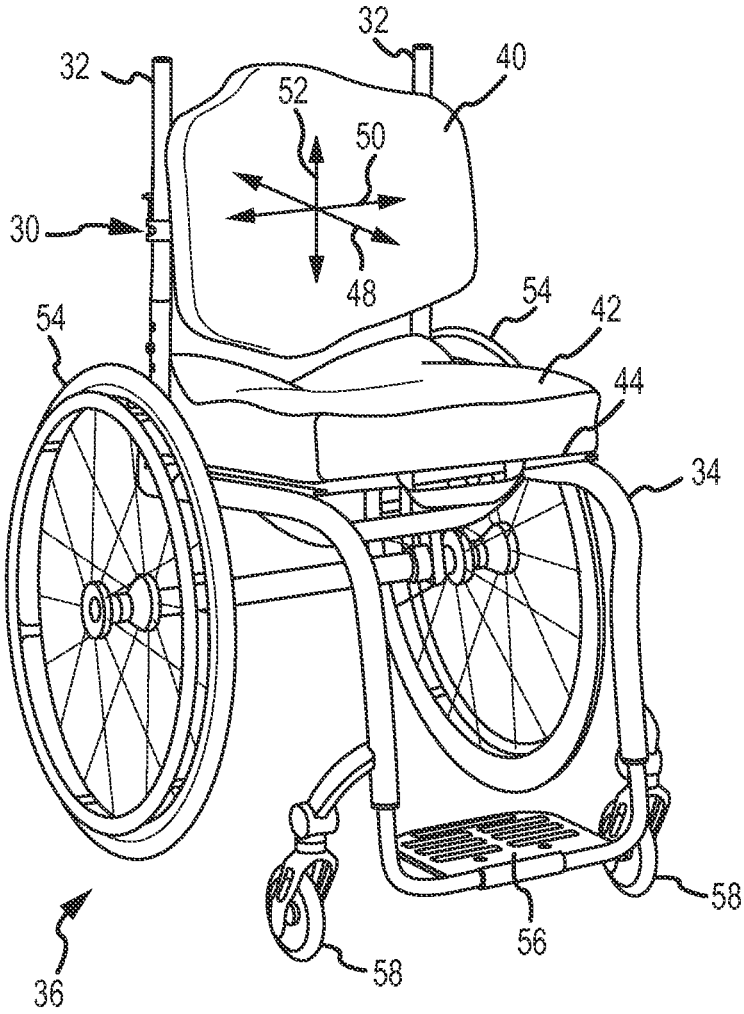
FIG. 2 is a front perspective view of the wheelchair shown in FIG. 1.
Figure 3:
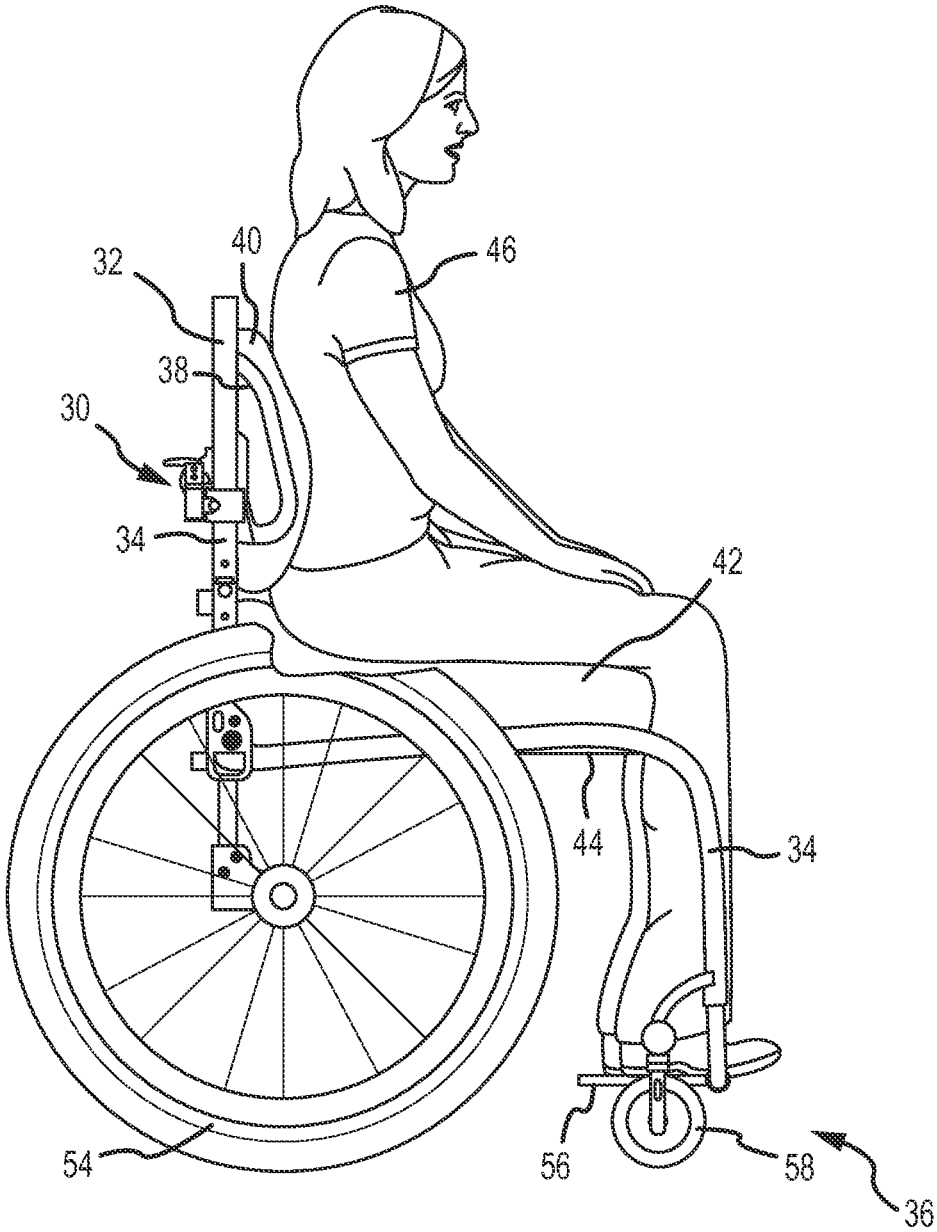
FIG. 3 is a side elevation view of the wheelchair shown in FIGS. 1 and 2, upon which a wheelchair user is seated.

A three-axis adjustable back support assembly 30 which embodies the present invention is shown generally in FIGS. 1-3. The back support assembly 30 is attached between upright posts or canes 32 on opposite transverse sides of a tubular frame 34 of a conventional wheelchair 36. The back support assembly 30 connects to and supports a back shell 38 to which a back cushion 40 is attached. The back shell 38 and the back cushion 40 are positioned relative to a seat cushion 42 which is supported on a platform 44 of the wheelchair frame 34. The position of the back shell 38 and back cushion 40 relative to the seat cushion 42 supports and locates the back and upper torso of a wheelchair user 46 (FIG. 3) seated on the wheelchair 36, to enable the user 46 (FIG. 3) to assume a proper and safe posture, while resting against the back cushion 40 and the seat cushion 42. Proper and safe posture on the wheelchair 36 is particularly important to a wheelchair user who has physical disabilities and associated posture and postural control impairments, such as those typically caused by congenital disorders, as well as wheelchair users who have a more typical size and shape but have been disabled by acquired or traumatic injuries or disease.

Figure 18D:
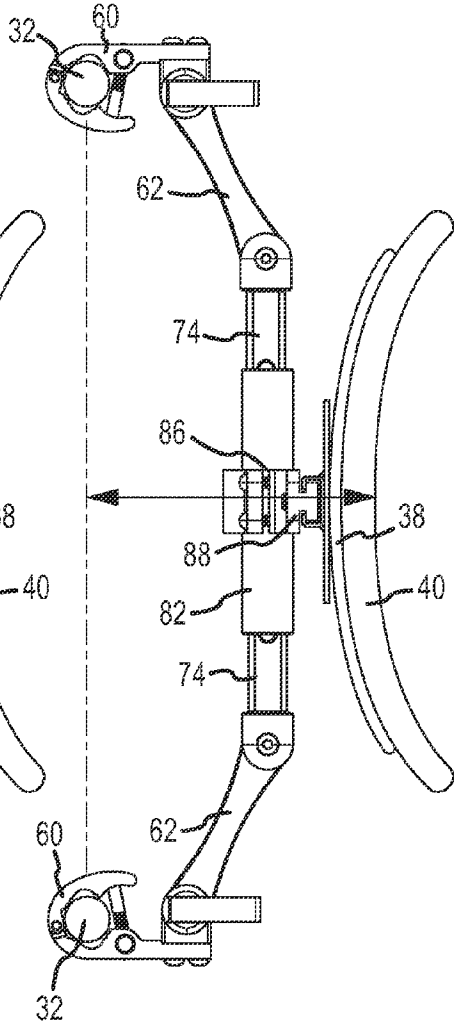
FIGS. 18A, 18B, 18C and 18D are generalized top plan views illustrating the range of longitudinal adjustment of the back support assembly shown in FIGS. 4 and 5, along the longitudinal axis shown in FIG. 2.
Figure 18C:
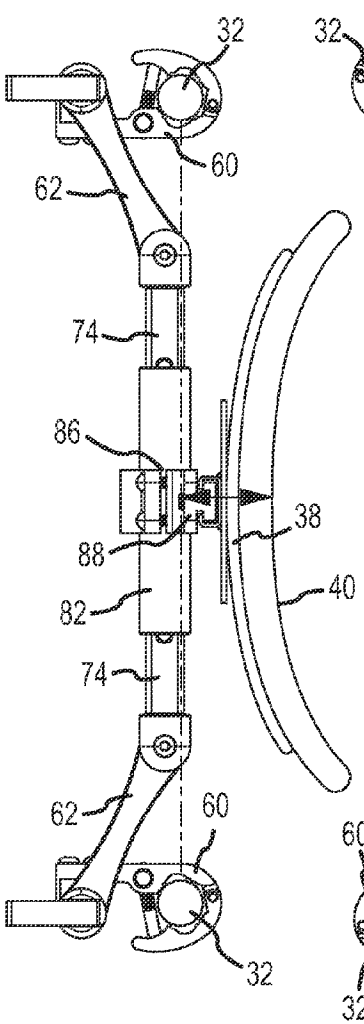
Figure 18B:
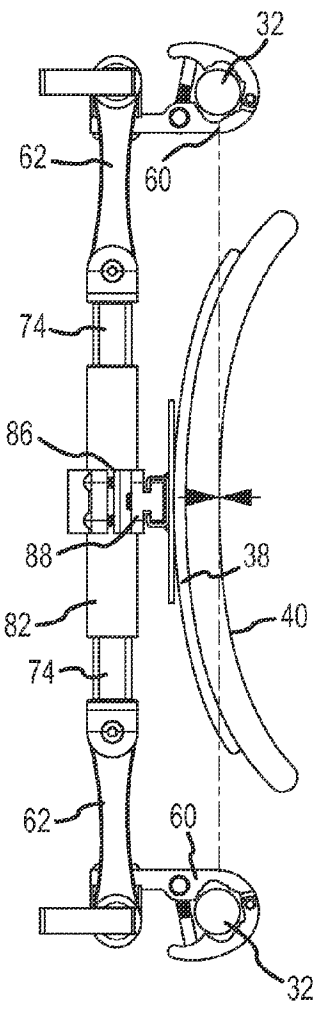
Figure 18A:
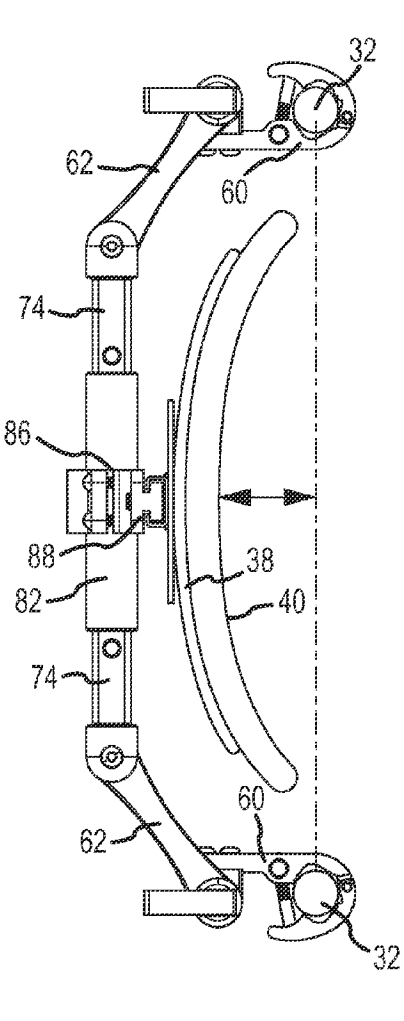
Figure 19B:
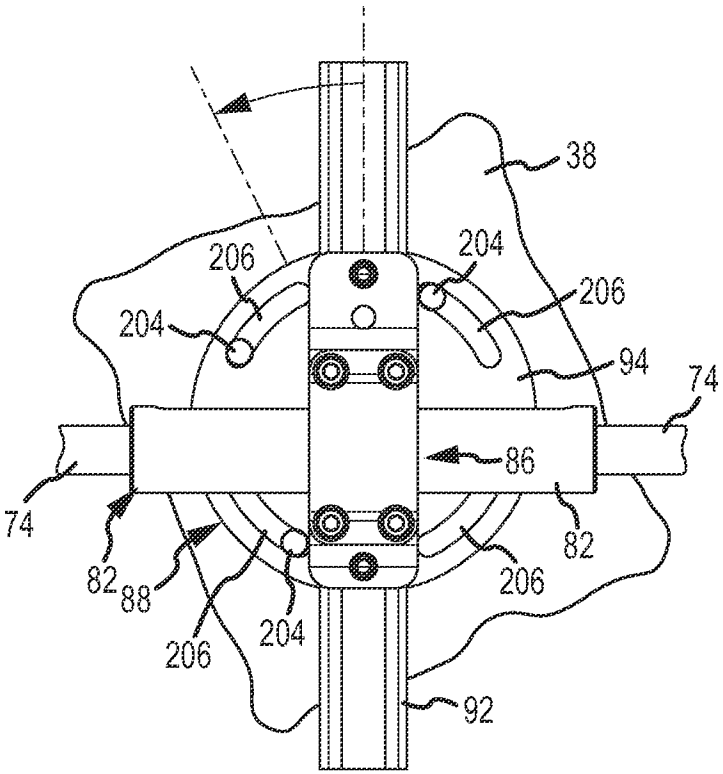
FIGS. 19A and 19B are rear elevation views of the back retaining clamp shown in FIG. 17, illustrating a range of pivotal adjustment of the back shell by the back support assembly shown in FIGS. 4 and 5, about the longitudinal axis shown in FIG. 2.
Figure 19A:
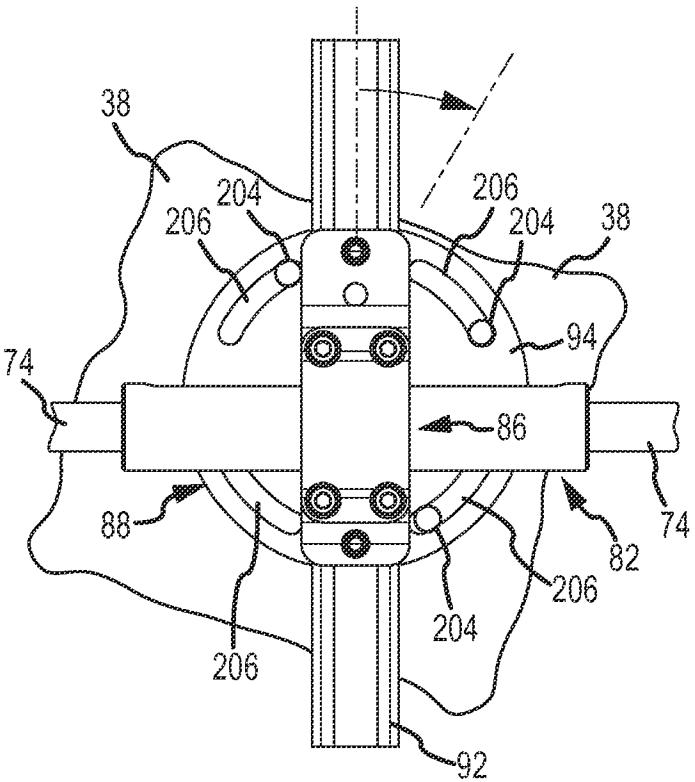
Figures 20A, 20B, 20C:
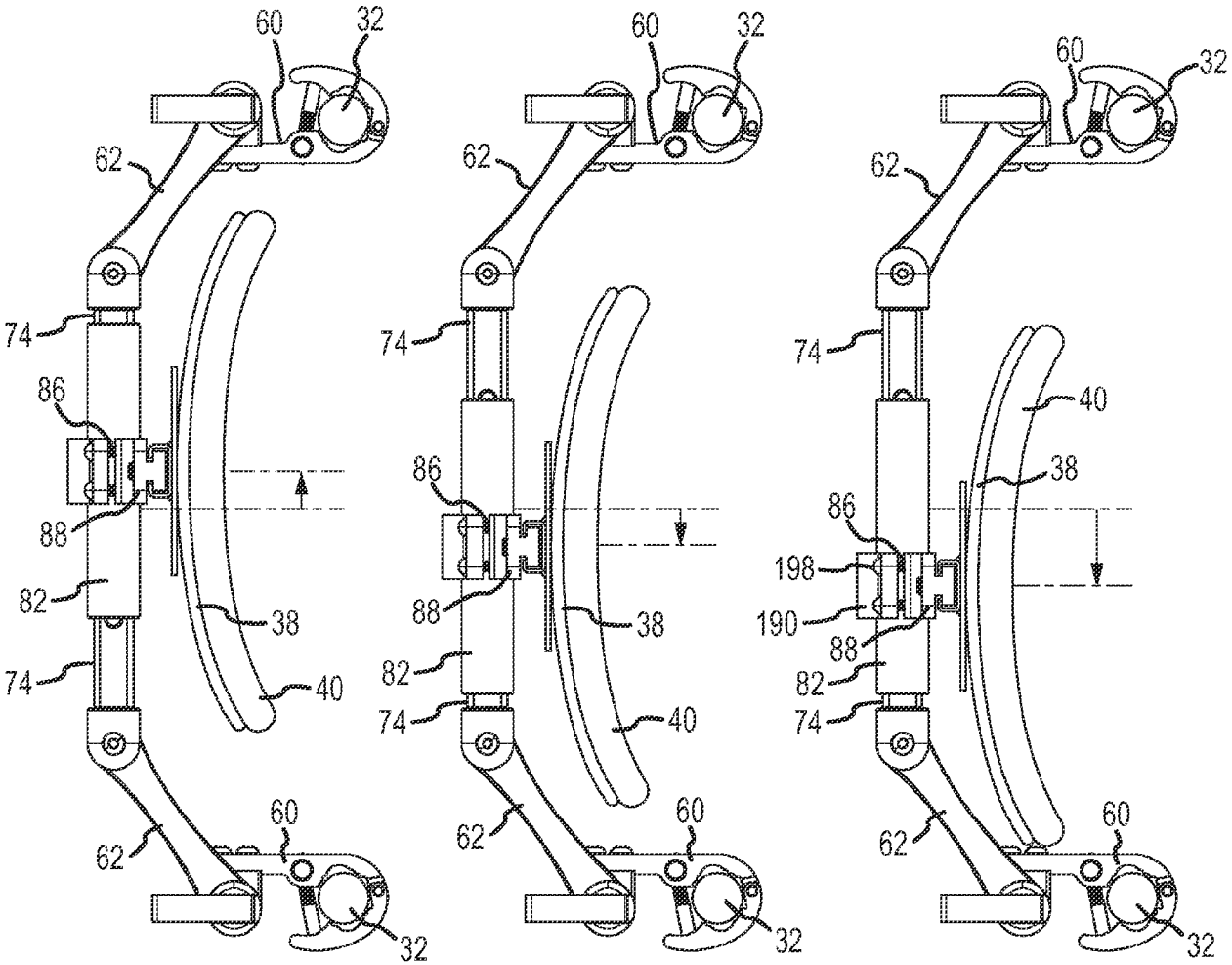
FIGS. 20A, 20B and 20C are generalized top plan views illustrating the range of transverse adjustment of the back support assembly shown in FIGS. 4 and 5, along the transverse axis shown in FIG. 2.
Figure 21A:
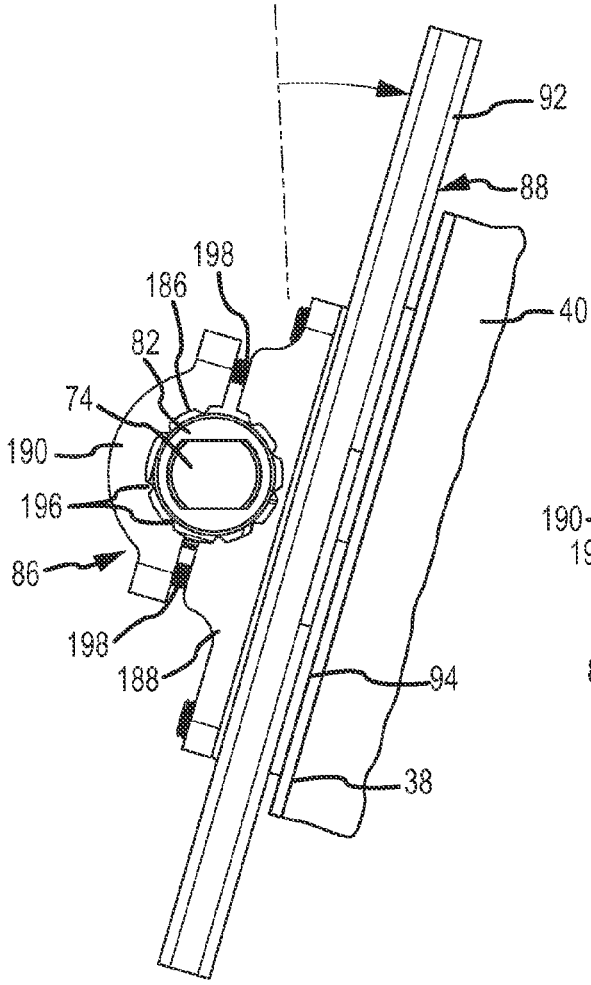
FIGS. 21A and 21B are generalized side elevation of views illustrating the range of pivoting adjustment of the back support assembly shown in FIGS. 4 and 5, about the transverse axis shown in FIG. 2.
Figure 21B:
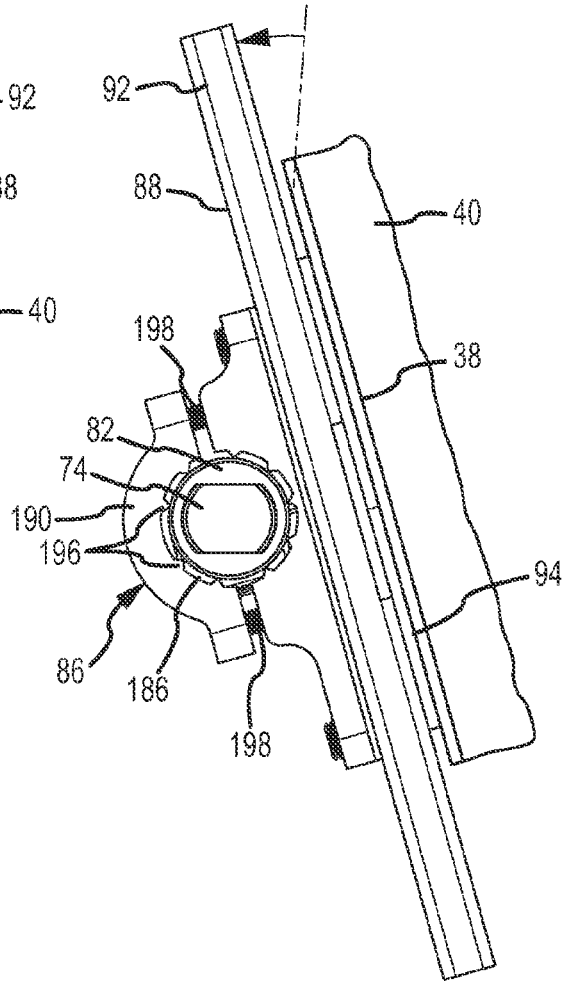

The three-axis back support assembly 30 positions and adjusts the back shell 38 and the back cushion 40 in a forward and backward manner (FIGS. 18A-18D) along a horizontal longitudinal axis 48 (FIG. 2), as well as pivots the shell 38 and cushion 40 about that axis 48 (FIGS. 19A and 19B). The back support assembly 30 also adjusts the shell 38 and cushion 40 in a side to side manner (FIGS. 20A-20C) along a horizontal transverse axis 50 (FIG. 2), and pivots the shell 38 and cushion 40 about that axis 50 (FIGS. 21A and 21B). The shell 38 and cushion 40 are also adjustable upward and downward (FIGS. 22A and 22B) along a vertical axis 52 (FIG. 2), and is also adjustable to pivot about that vertical axis 52 (FIGS. 23A and 23B), by the back support assembly 30.

The conventional wheelchair 36 with which the back support assembly 30 is used typically has two drive wheels 54 which are attached on opposite sides of the wheelchair frame 34 by which the user 46 can maneuver the wheelchair 36. Foot rests 56 extend downward from the frame 34 below the forward edge of the seat cushion 42 to support the feet of the user 46. Casters 58 extend from the wheelchair frame 34 in front of the drive wheels 54 to provide the stability of a four-wheeled vehicle.

Although not specifically shown, many conventional wheelchair frames 34 are collapsible in a transverse direction, to facilitate storage and transportation. The back support assembly 30 is disconnectable from the canes 32 of the wheelchair frame 34 to separate the back shell 38 and back cushion 40 from the frame 34, thereby allowing the wheelchair 36 to be collapsed.

Figure 4:
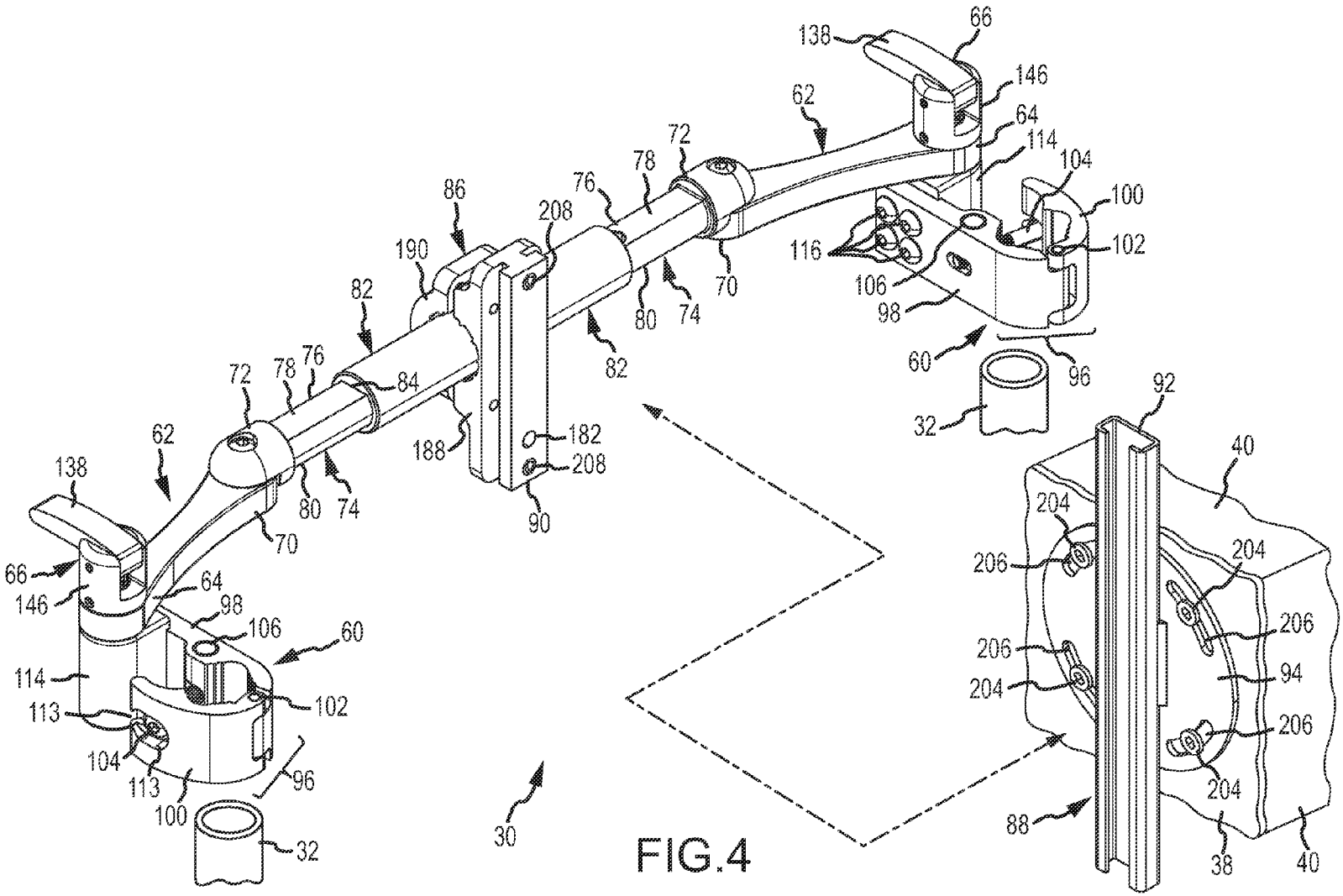
FIG. 4 is an perspective view of the back support assembly shown in FIG. 1 with portions illustrated from different perspectives shown by a broken line.
Figure 5:
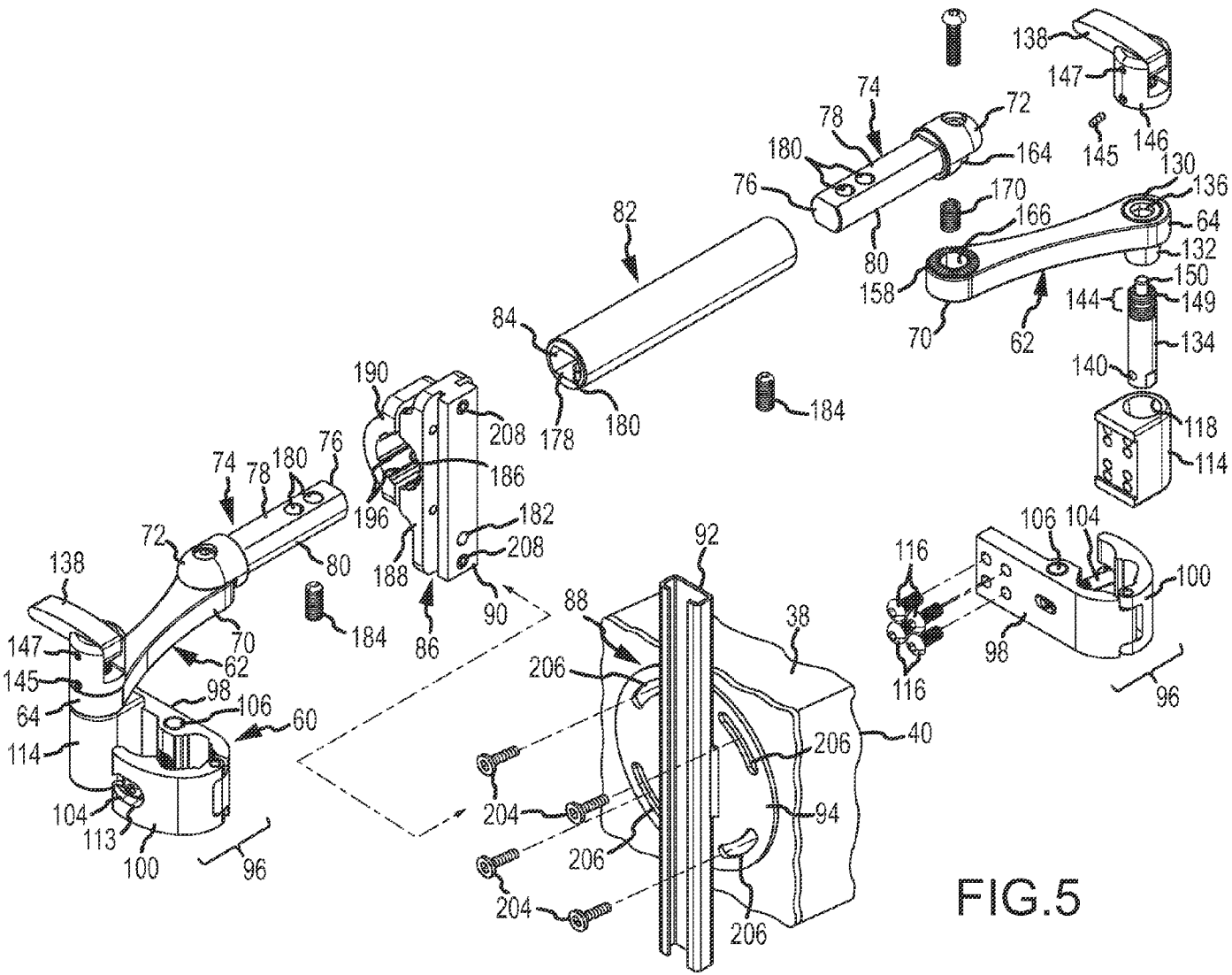
FIG. 5 is a perspective view of the back support assembly shown in FIG. 4, with the some of the components shown in an exploded relationship.
Figure 16:
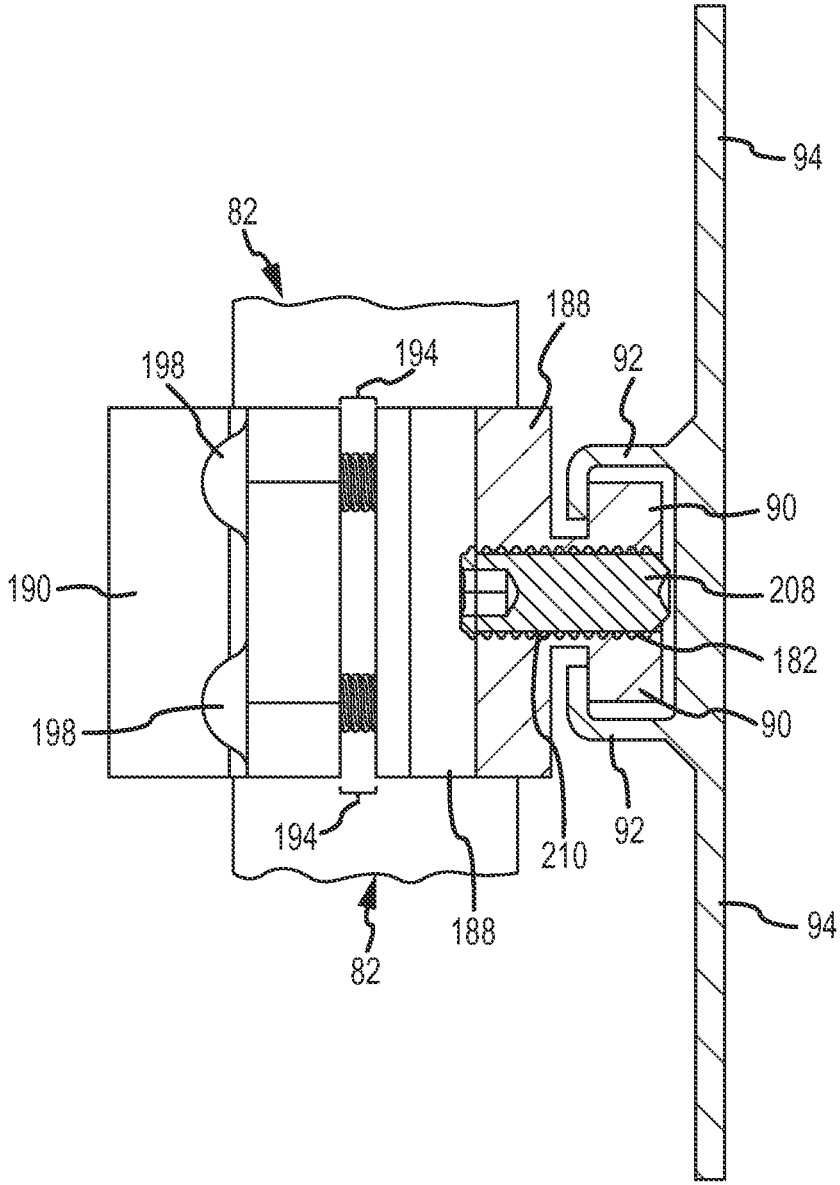
FIG. 16 is a top plan view of the back retaining clamp, shown partially sectioned in the plane of line 16-16 in FIG. 15, with a back shell connector of the back support assembly shown in FIGS. 4 and 5 connected to the back retaining clamp.

The back support assembly 30 is shown in more detail in FIGS. 4 and 5, as it is attached to the canes 32 of the wheelchair. Adjustment arms 62 are attached at their first outer ends 64 to each mounting device 60 by a release lever pin 66 (FIG. 9), or alternatively by a solid pin 68 (FIG. 10). An opposite second inner end 70 of each adjustment arm 62 pivotally connects to a first outer end 72 of an extension arm 74. The angle of the adjustment arm 62 and the extension arm 74 is fixed in a selectively adjustable manner to prevent the arms 62 and 74 from pivoting relative to one another. The remaining, second, inner ends 76 of each extension arm 74 have an overall cross-sectional configuration of a parallel-segmented circle, formed by two flat, parallel extending segments 78 and 80 located diametrically opposite from one another. The two inner ends 76 of the two extension arms 74 each extend into opposite ends of a center connecting structure or hollow tube 82. A center opening 84 of the connecting tube 82 has a cross-sectional configuration of the same or complementary shape as the inner portions 76 of the extension arms 74 (FIG. 13), thereby preventing the connecting tube 82 from rotating relative to the extension arms 74. A back retaining clamp 86 is firmly attached to the connecting tube 82 to prevent rotation relative to the connecting tube 82. A back shell connector 88 is adjustably connected to the back shell 38. The back shell connector 88 and the back retaining clamp 86 are interconnected by a T-shaped bar portion 90 of the back retaining clamp 86 which extends into and moves along a C-shaped channel 92 of back shell retaining assembly 88 (FIG. 16). The C-shaped channel 92 is rigidly attached to a circular plate 94, and the back shell 38 is rigidly connected to the plate 94 at selectively adjustable pivoted positions (FIGS. 19A and 19B).

Forward and backward longitudinal adjustment of the back shell 38 and back cushion 40 along the longitudinal axis 48 (FIG. 2) is achieved by the selective degree to which the adjustment arms 62 are pivoted forward and backward (FIGS.

18A-18C), and by the selective attachment of the mounting devices 60 in front of or behind the canes 32 (FIGS. 18A-18C compared to FIG. 18D). Side to side transverse adjustment of the shell 38 and cushion 40 along the transverse axis 50 (FIG. 2) is achieved by the selective transverse position of the connecting tube 82 relative to the ends 76 of the extension arms 74 (FIGS. 20A and 20B), and by the selectively adjustable position of the back retaining clamp 86 on the connecting tube 82 (FIG. 20C). Upward and downward vertical adjustment of the shell 38 and cushion 40 about the vertical axis 52 (FIG. 2) is achieved by the selective retained position of the back shell connector 88 relative to the back retaining clamp 86, due to the sliding movement of the T-shaped bar portion 90 in the C-shaped channel 92 (FIGS. 22A and 22B), as well as the vertical positions at which the mounting devices 60 are connected to the canes 32. Additional upward or downward movement of the shell 38 and cushion 40 is achieved by inverting the back retaining clamp 86 on the connecting tube 82 relative to the position shown in the drawings.

Figure 23A:
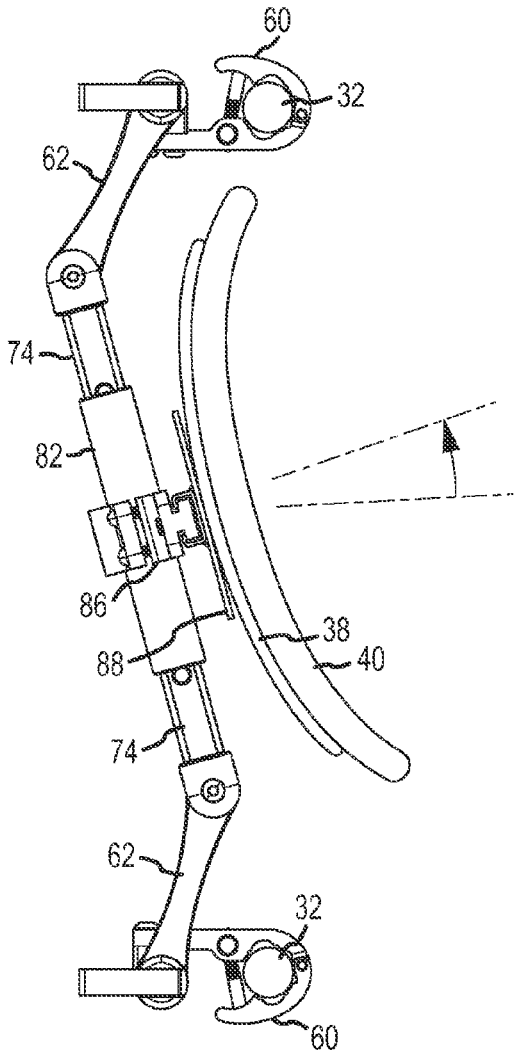
FIGS. 23A and 23B are generalized top plan views illustrating the range of pivoting adjustment of the back support assembly shown in FIGS. 4 and 5, about the vertical axis shown in FIG. 2.
Figure 23B:
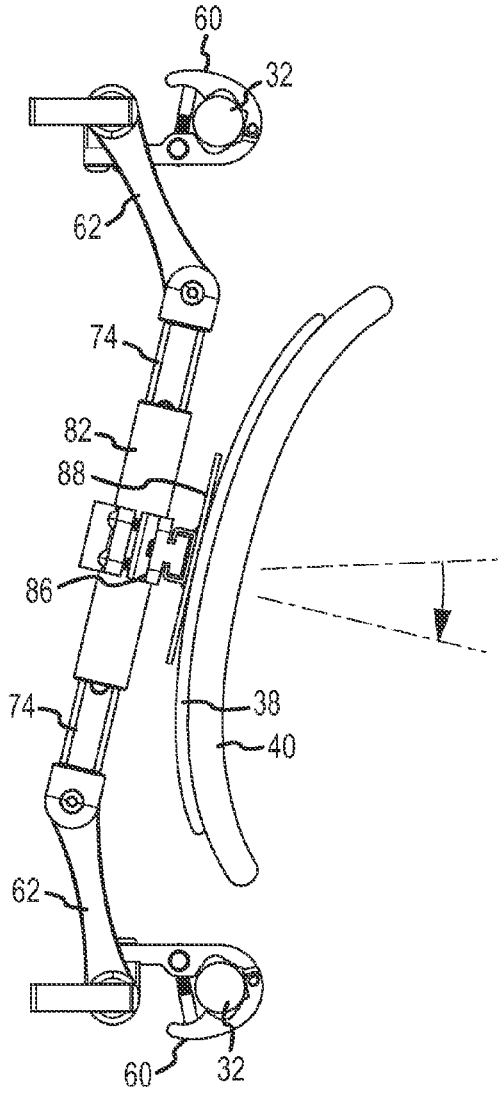

The rotational or pivotal position of the back shell 38 and the back cushion 40 about the longitudinal axis 48 (FIG. 2) is achieved by establishing the relative pivoted position of the back shell 38 connected to the circular plate 94 of the back shell connector 88 (FIGS. 19A and 19B). The rotational or pivotal position of the shell 38 and cushion 40 about the transverse axis 50 (FIG. 2) is achieved by establishing the relative pivoted position of the back retaining clamp 86 on the connecting tube 82 (FIGS. 21A and 21B). The rotational or pivotal position of the shell 38 and cushion 40 about the vertical axis 52 (FIG. 2) is achieved by establishing the separate and independent pivoting of each adjustment arm 62 relative to the mounting devices 60 and the extension arms 74 on opposite transverse sides of the wheelchair frame 34 (FIGS. 23A and 23B).

As described, the back support assembly 30 offers the capability of independently positioning the back shell 38 and back cushion 40 along the each of the three mutually perpendicular axes 48, 50 and 52 (FIG. 2), as well as independently positioning the shell 38 and cushion 40 in a pivoted relationship about each of these three mutually perpendicular axes. The back support assembly 30 has the capability to achieve these selective longitudinal and rotational positions along and about these three mutually perpendicular axes independently, quickly, efficiently and effectively, without disassembling any components of the back support assembly 30, and without adversely effecting the previously-attained desirable positions along and about any of the other mutually perpendicular axes 48, 50 and 52. Once a desired initial position is achieved, a finer adjustment in position along and about each of the three axes is achieved by adjusting only the desired position without adversely affecting the positions along and about the other axes. The mounting devices 60, adjustment arms 62, extension arms 74, the connecting tube 82, the back retention clamp 86 and the back shell retaining assembly 88 interact together to achieve these desirable improvements.

More details concerning each of the components 60, 62, 74, 82, 86 and 88 of the support assembly 30 are described below.

Figure 6:
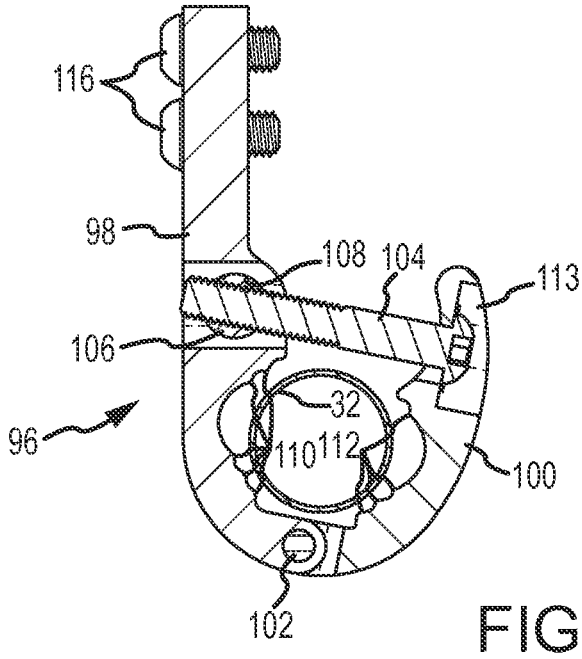
FIG. 6 is a horizontal cross sectional view of a clamp of a mounting device of the back support assembly shown in FIGS. 4 and 5.

Each mounting device 60, as shown in FIGS. 4, 5 and 6, includes a clamp 96 formed by an attachment bracket 98 and a retention bracket 100. The attachment bracket 98 and the retention bracket 100 are pivotally connected together by a hinge pin 102 which extends through the adjoining ends of the brackets 98 and 100. The retention bracket 100 is drawn toward the attachment bracket 98 by tightening a bolt 104 into a cylindrical barrel nut 106 which is pivotally positioned within a cylindrical opening 108 in the attachment bracket 98. Ribs 110 and 112 of the attachment and retention brackets 98 and 100, respectively, grasp the canes 32 when the bolt 104 is tightened, thereby rigidly fastening each clamp 96 to one cane 32. Because the retention bracket 100 is pivotal to a significant degree relative to the attachment bracket 98, different-diameter canes 32 of different wheelchairs may be effectively grasped with the single clamp 96. It is therefore unnecessary to substitute parts or disassemble the clamp 96 when connecting the support assembly 30 to different diameter wheelchair canes. Furthermore, the head of the bolt 104 is separable from the retention bracket 100 through a slot 113 to allow the cane 32 to be inserted into the space between the ribs 110 and 112, before the head of the bolt 104 is again inserted in the slot 113 and connected with the retention bracket 100. In this manner, each clamp 96 is directly located on each cane 32 without the necessity of sliding the clamp 96 from an upper end of the cane 32 along the length of the cane 32 until the desired position is reached. The bolt 104 stays connected to the barrel nut 106 when the clamp 96 is opened to accept the cane 32 in the manner described.

Figure 7A:
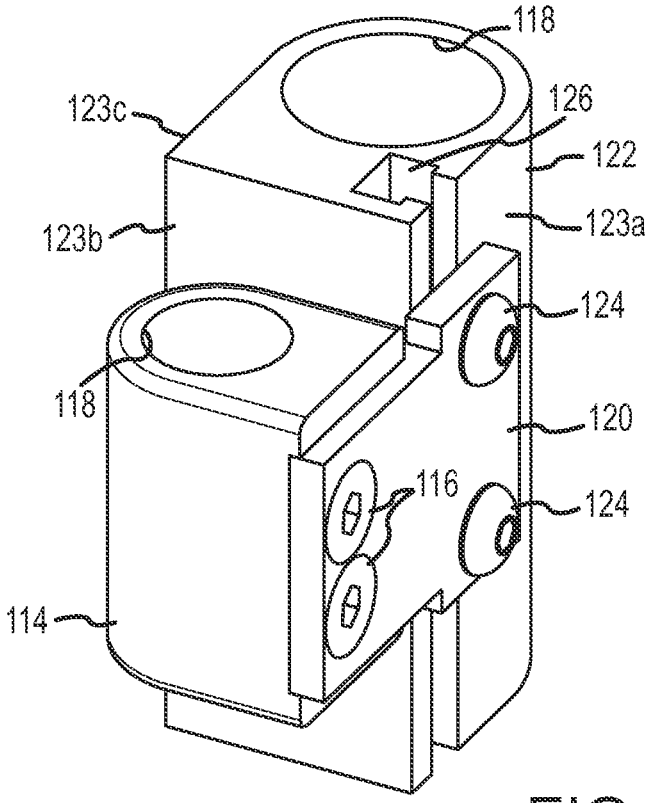
FIG. 7A is a perspective view of a receiver block of the mounting device of the back support assembly shown in FIGS. 4 and 5, illustrated connected in an alternative manner to a non-circular cane of a wheelchair by an attachment bracket.

A receiver block 114 is attached to the attachment bracket 98 by bolts 116, as shown in FIGS. 4 and 5. In the circumstance where the canes 32 of a wheelchair frame 34 may not have a circular configuration, or a polygon configuration which approximates a circular configuration, the receiver block 114 may be attached to such a non-circular cane by the use of an attachment plate 120, as shown in FIG. 7A. In the circumstance where the wheelchair may not have canes at all, for example in an electric wheelchair which has a solid or integral back similar to that of a conventional chair, the receiver block 114 may be attached to the solid back as shown in FIG. 7B.

As shown in FIG. 7A, a cane 122 has three mutually perpendicular flat surfaces 123*a*, 123*b* and 123*c*. The attachment plate 120 is connected to the cane 122 by bolts 124 which extend into a slot 126 which extends along the cane 122 parallel to the flat surface 123*a*. Nuts (not shown) are located in the slot 126 and connect to the threaded ends of the bolts 124 to rigidly hold the attachment plate 120 in position against the flat surface 123*a*. The receiver block 114 is then attached to the attachment plate 120 by use of the bolts 116, in a similar manner as the receiver block 114 is attached to the attachment bracket 98 by the bolts 116 (FIG. 4). Connected in this manner, the receiver block 114 is located adjacent to the flat surface 123*b* of the cane 122.

Figure 7B:
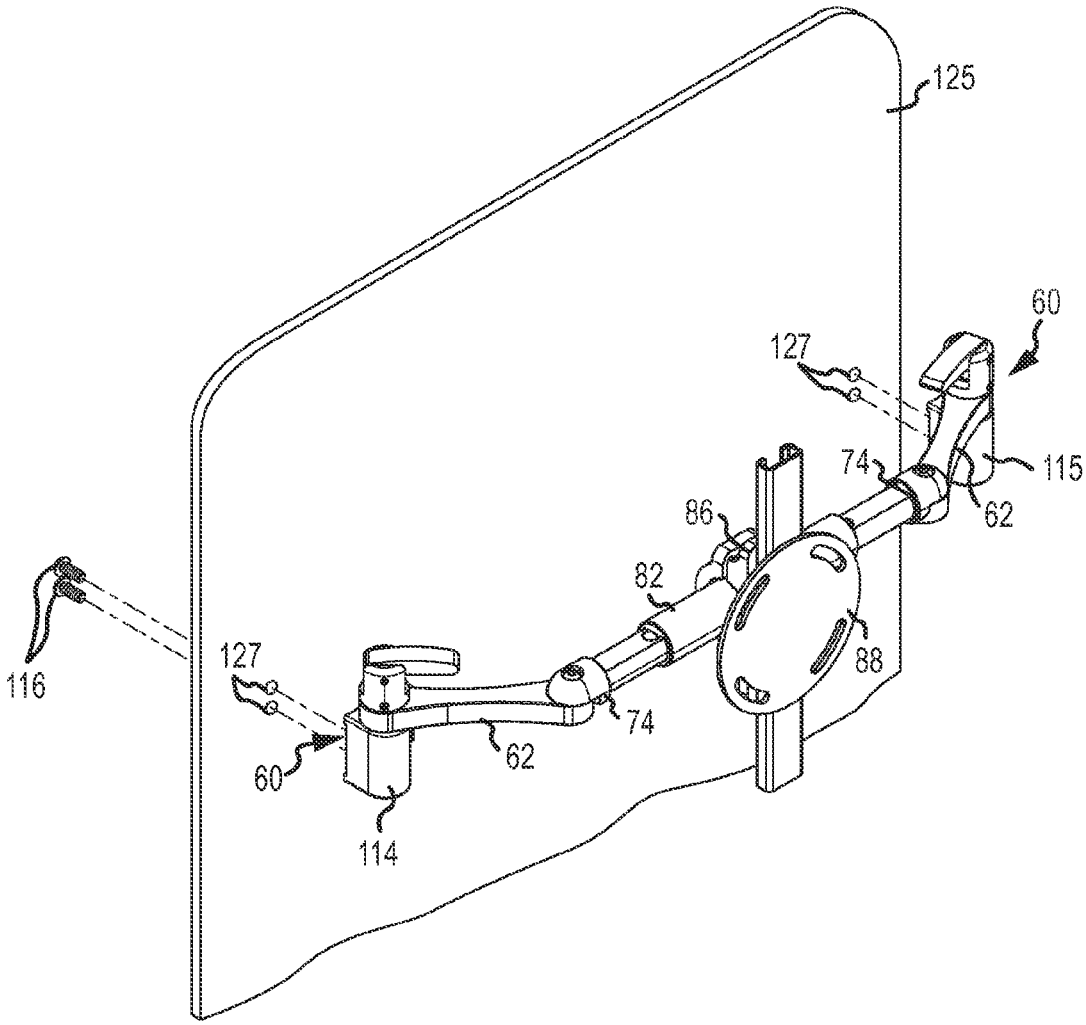
FIG. 7B is an exploded perspective view of a receiver block of the mounting device of the back support assembly shown in FIGS. 4 and 5, illustrated connected in another alternative manner to a solid back of another type of wheelchair.

As shown in FIG. 7B, a solid structural back 125 of a type of wheelchair which does not have canes, such as an electric wheelchair (not shown), is used to retain the support assembly 30. Holes 127 are formed through the back 125 at positions where the receiver blocks 114 are to be attached to the back 125. The bolts 116 are then inserted through the holes 127, and are tightened into the receiver blocks 114 to rigidly attach the receiver blocks 114 to the back 125. The adjustment arms 114 are connected to the receiver blocks 114, and the back support 30 functions as described, except that the longitudinal position of the center connecting tube 82, the back retaining clamp 86 and the back shell connector 88 cannot be moved to a position longitudinally behind the back 125.

Figure 8:
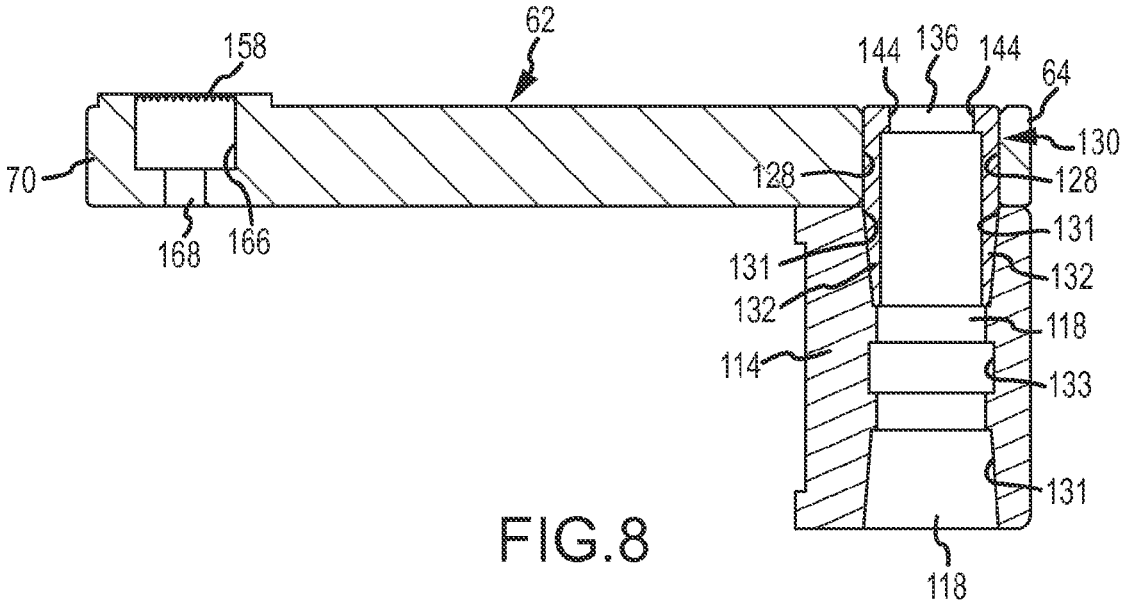
FIG. 8 is a vertical cross-sectional view of an adjustment arm of the back support assembly shown in FIGS. 4 and 5, shown positioned in a receiver block of the back support assembly shown in FIGS. 4, 5 and 7.
Figure 9:
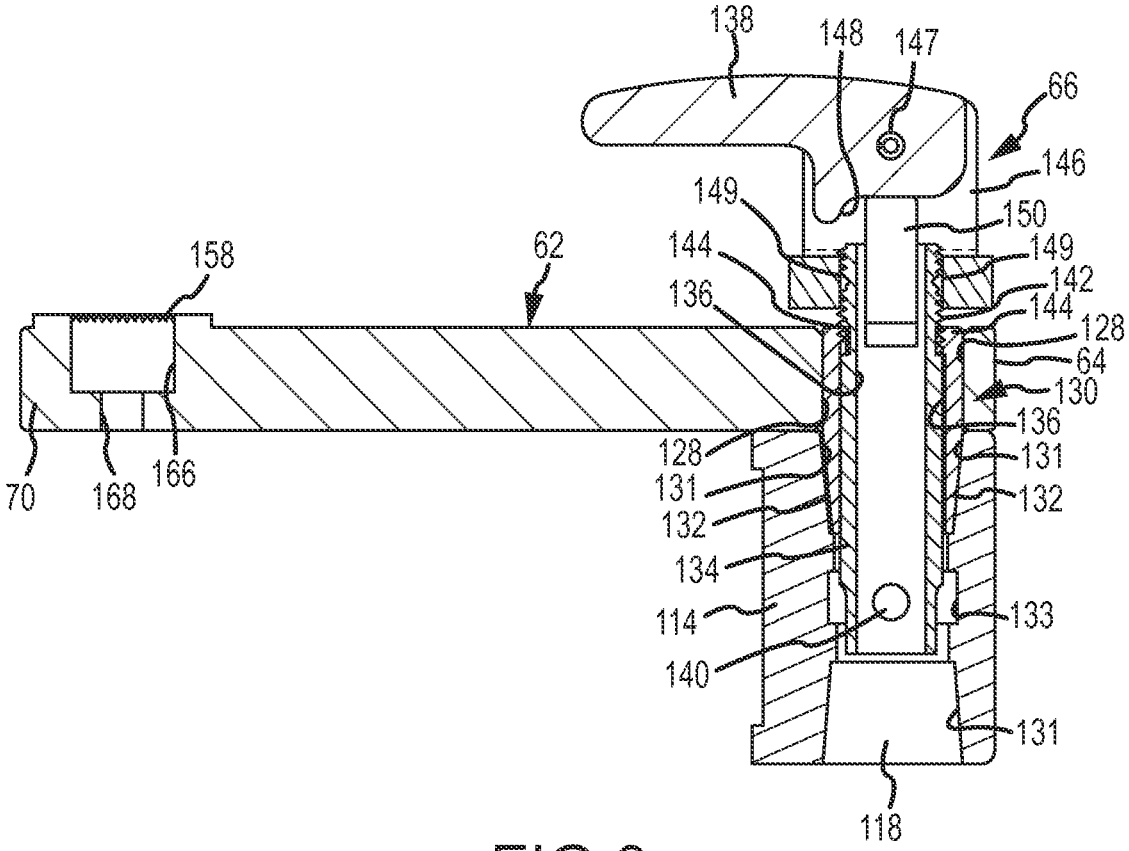
FIG. 9 is the vertical cross-sectional view of FIG. 8 with an attached release lever pin of the back support assembly shown in FIGS. 4 and 5.
Figure 10:
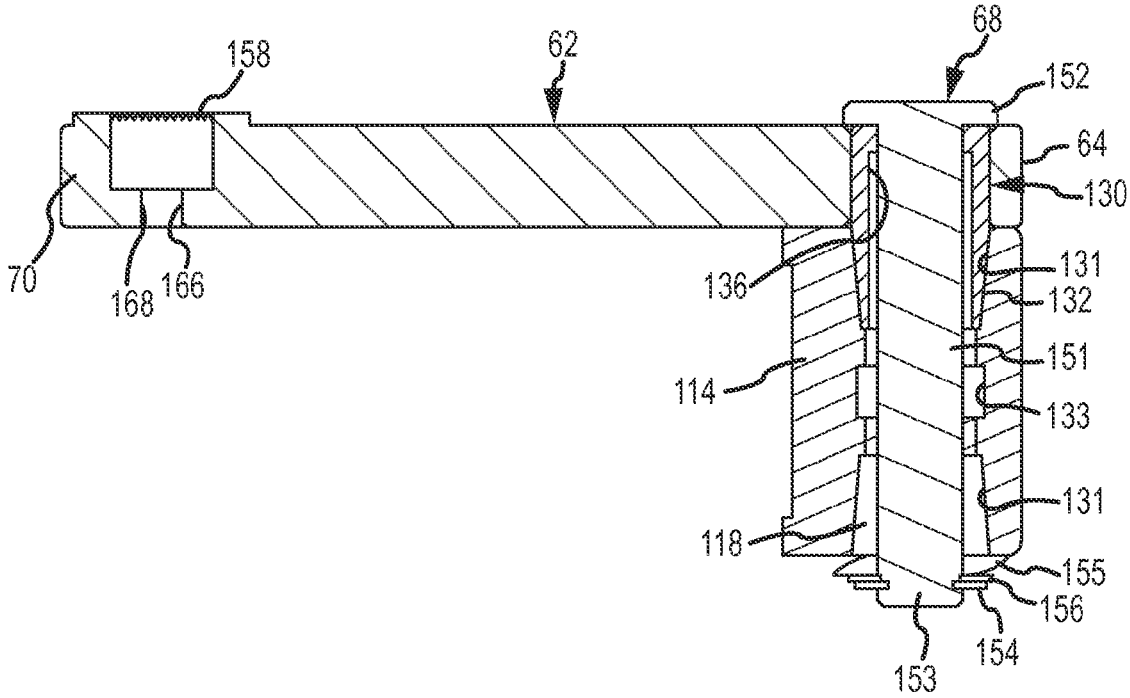
FIG. 10 is the vertical cross-sectional view of FIG. 8 with an attached solid connection pin of the back support assembly shown in FIGS. 4 and 5, used as an alternative to and in substitution for the release lever pin shown in FIGS. 4, 5 and 9.

Each adjustment arm 62 is attached to the receiver block 114 as shown in FIGS. 8-10. A tapered receiver opening 118 extends vertically in each receiver block 114. The first end 64 of an adjustment arm 62 is attached to the receiver block 114 by inserting the release lever pin 66 (FIG. 9) or the solid pin 68 (FIG. 10) into the receiver opening 118.

The first end 64 of each adjustment arms 62 has a cylindrical opening 128 formed therein. A bushing 130 is press fit into the opening 128. The bushing 130 has a length greater than the thickness of the adjustment arm 62. An upper portion (as shown) of the bushing 130 is cylindrically shaped and is press fit within the cylindrical opening 128. A conically-shaped tapered bottom portion 132 of the bushing 130 extends below the adjustment arm 62. The tapered bottom portion 132 extends within the receiver opening 118, when the adjustment arm 62 is connected to the receiver block 114. The receiver opening 118 is conically shaped at opposite end portions 131 to diverge radially inwardly and axially toward the center of the receiver block 114. An annular indention 133 extends radially outward from the innermost tapered ends of the receiver opening 118, at approximately a mid-point along the length of the receiver opening 118. The degree of conical taper of the end portions 133 of the receiver opening 118 essentially matches or corresponds with the degree of taper of the bottom portion 132 of the bushing 130.

The conically tapered portions 131 and 132 of the receiver opening 118 and the bushing 130, respectively, offer a number of important improvements. First, because the bottom portion 132 of the bushing 130 is tapered, insertion of the bushing 130 in the receiver opening 118 is more easily accommodated, because an exact coaxial alignment is not required initially. Once the conically tapered portion 132 starts into the receiver opening 118, that movement aligns the bushing coaxially with the tapered portion 131 receiver opening 118. In contrast in those prior art devices which utilize cylindrical structures which must fit within cylindrical openings, it is very difficult to achieve the precise coaxial alignment necessary to insert the two cylindrical pieces together, thereby frustrating attempts to assemble the pieces.

A second important improvement is that the complementary conical-shaped taper of the receiver opening portion 131 and the bushing portion 132 permits a very tight or close-tolerance fit between the bushing 132 and the receiver opening 118. The close-tolerance fit eliminates a feeling of looseness of the assembled parts, which is typical in prior art devices, and which is not regarded favorably by wheelchair users who perceive the detectable looseness between connected parts as a weakness in the mechanism and lack of secure support.

A third important improvement is that the conically tapered portions 131 and 132 facilitate easy withdrawal of the bushing 130 from the receiver opening 118 to disconnect the adjustment arms 62 from the receiver blocks 114, when the support assembly 30 is disconnected from the wheelchair to allow the wheelchair to collapse. Easy withdrawal is facilitated because once the separation movement between the adjustment arm 62 and the receiver block 114 is even slightly initiated, the taper of the portions 131 and 132 increases the separation between the bushing 130 and the receiver block 114 for a quick and easy release, and coaxial alignment of the parts is not required for separation.

A fourth important improvement is that the outer ends 64 of the adjustment arms 62 are freely pivotal within the receiver blocks 114. The free pivotal movement greatly decreases the complexity of installation set up and adjustments, because it is not necessary to loosen or tighten clamps or other mechanical devices at the outer ends 64 of the adjustment arms 62 to achieve the desired angular orientation of the adjustment arms. Instead, the pivotal orientation of the adjustment arms 62 in the receiver blocks 114 is fixed by the single connection between the adjustment arms 62 and the extension arms 74, thereby maintaining the desired angular orientation with only a single connection between the two arms 62 and 74.

The release lever pin 66 secures the outer end 64 of each adjustment arm 62 to the receiver block 114, as shown in FIG. 9. The structure and operation of the release lever pin 66 is conventional. A cylindrical shaft 134 of the release lever pin 66 extends through a center opening 136 in the bushing 130 and downward into the opening 118 of the receiver block 114. When a lever 138 of the release lever pin 66 is pivoted downward (as shown), balls 140 project radially outward from the lower end of a cylindrical shaft 134 into the annular indention 133. The outward projected balls 140 prevent the cylindrical shaft 134 from withdrawing from the receiver opening 118 of the receiver block 114, thereby maintaining the connection of the release lever pin 66 and the adjustment arm 62 to the receiver block 114. Lifting the lever 138 withdraws the balls 140 into the cylindrical shaft 134, and allows separation of the first end 64 of the adjustment arm 62 from the receiver block 114, thereby allowing disconnection of the support assembly 30 from the wheelchair frame 34.

A non-conventional aspect of the release lever pin 66 is that it is rigidly connected to the outer end 64 of the adjustment arm 62, so that the release lever pin 66 remains associated with the adjustment arm 62. Such a rigid connection and association is useful in preventing the disconnection or loss of the release lever pin 66 from the adjustment arm 62, thereby avoiding the necessity to keep track of separate parts when using the back support assembly 30. The upper end of the cylindrical shaft 134 is threaded at 142, and the upper end of the opening 136 in the bushing 130 is also threaded at 144. The cylindrical shaft 134 is inserted into the center opening 136 of the bushing 130, and the threads 142 of the shaft 134 are screwed into the threads 144 at the upper end of the opening 136 in the bushing 130. Because the bushing 130 is press fit into the cylindrical opening 128, the threaded connection at 142/144 firmly retains the release lever pin 66 to the adjustment arm 62.

A clevis 146 is held in place on the upper end of the cylindrical shaft 134 of the release lever pin 66 by one or more set screws 145 (FIG. 5) which extend into an annular groove 149 formed in the threads 142. Extending each set screw 145 into the annular groove 149 allows the lever 138 to be selectively rotated to a position for convenient access while still securing it in the desired position by tightening the set screws 145. The lever 138 is pivotally connected to the clevis 146 by a pivot pin 147. The lever 138 has a cam surface 148 which pushes a center rod 150 downward within the cylindrical shaft 134 to extend the balls 140 when the lever 138 is pivoted down (as shown). Conversely, the balls 140 withdraw into the cylindrical shaft 134 when the lever 138 is pivoted upward (not shown).

The solid pin 68, shown in FIG. 10, is an alternative to the release lever pin 66 (FIG. 9) for securing the outer end 64 of each adjustment arm 62 to the receiver block 114. The solid pin 68 includes a cylindrical shaft 151 which extends downward from a wider-diameter head 152 through the center opening 136 in the bushing 130 and through the bottom tapered portion 131 of the receiver opening 118, to a lower end 153 of the pin 68. The lower end 153 extends out of the receiver opening 118 below the receiver block 114 (as shown). The lower end 153 of the shaft 151 has an annular groove formed into which a side-mounted retaining ring 154 is retained. A wave washer 155 followed by a flat washer 156 is inserted over the lower end 153 of the shaft 151 before the retaining ring 154 is connected to the shaft in 153. The wave washer 155 imparts a slight axial force between the lower end of the receiver block 114 and the flat washer 156 and the retaining ring 154. That axial force is transferred through the solid pin 68 to hold the head 152 firmly against the upper end of the bushing 130. The slight axial force transferred by the wave washer 155 holds the conically shaped tapered portions 131 and 132 together, thereby eliminating looseness and creating a feeling of solid stability. In general, the solid pin 68 will be used in those circumstances where the back support assembly 30 will not be removed from the wheelchair 36, except very infrequently.

Another important improvement of the bushing 130 is that it accepts the load transferred between the adjustment arm 62 and the receiver block 114 and relieves the cylindrical shaft 134 of the release lever pin 66 or the cylindrical shaft 151 of the solid pin 68 from assuming this load. As a consequence of eliminating the load on the shafts 134 and 151 of the pins 66 and 68, it is easier to disconnect the support assembly 30 from the wheelchair. Any torsional load on the prior art cylindrical pins and openings will create problems in connection and separation, because of a tendency to depart from a precise coaxial alignment. These problems can be avoided in the prior art by increasing the clearance between the cylindrical pin and the cylindrical opening, but that increased clearance creates the looseness which is perceived as a weakness in support by the wheelchair user.

Figure 11:
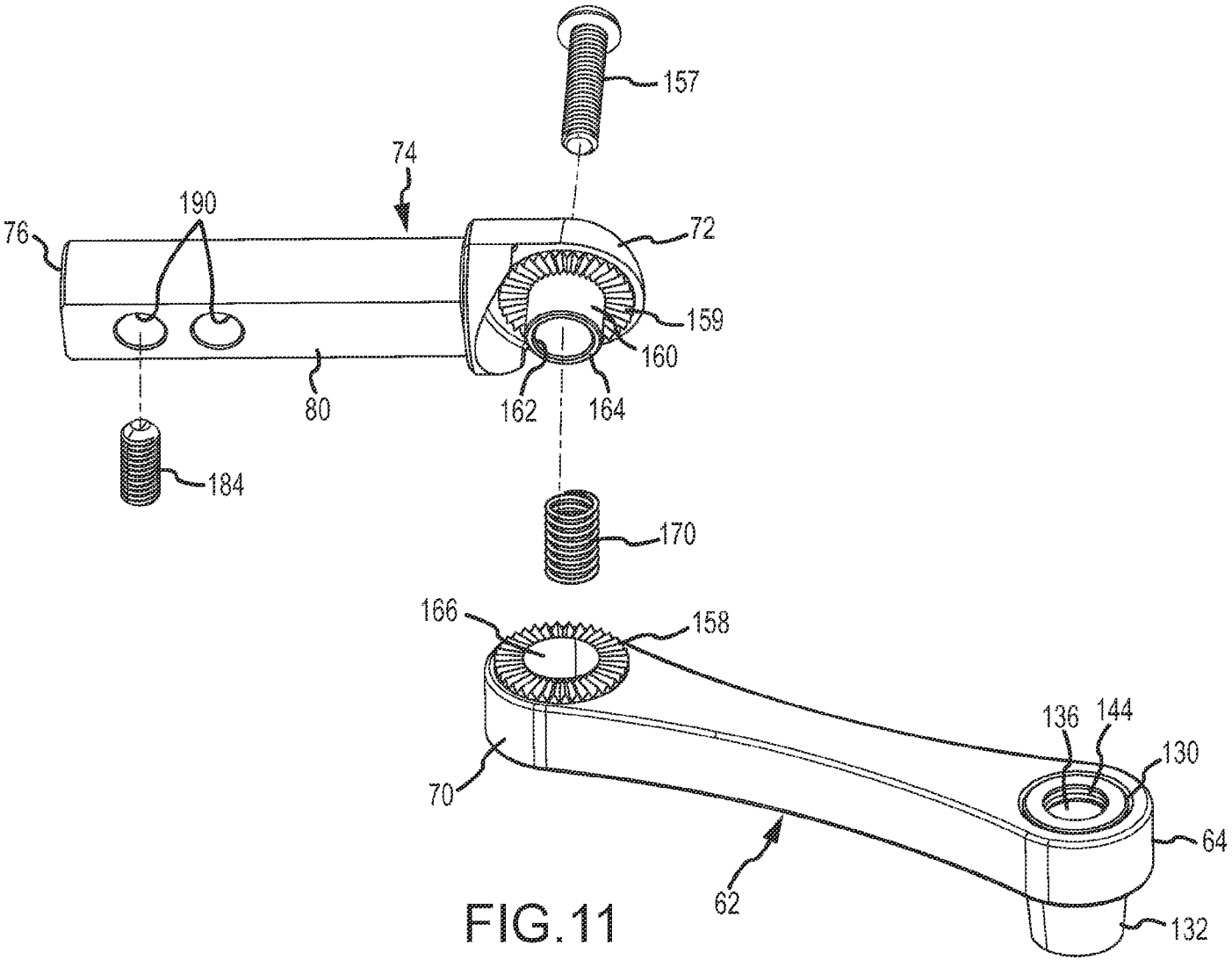
FIG. 11 is an exploded perspective view of an adjustment arm and an extension arm of the back support assembly shown in FIGS. 4 and 5, with different perspectives of the adjustment arm and the extension arm illustrated by a broken line.
Figure 12:
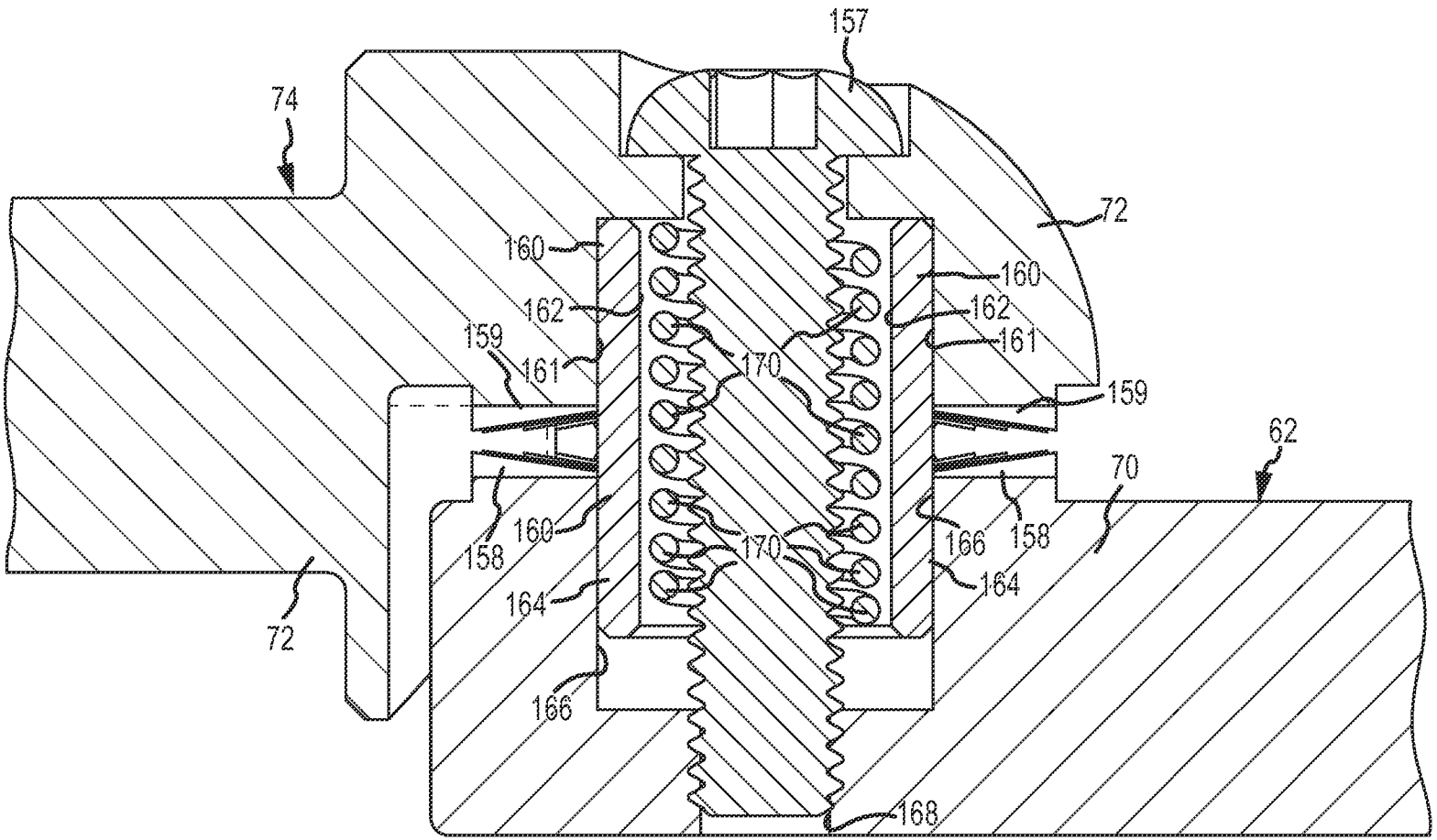
FIG. 12 is a partial vertical cross-sectional view of the assembled relationship of the adjustment arm and the extension arm shown in FIG. 11, illustrating disengagement during adjustment of the back support assembly.

The second opposite inner end 70 of the adjustment arm 62 is pivotally connected to the first outer end 72 of an extension arm 74 by a bolt 157, as shown in FIGS. 11 and 12. An annular mating area 158 formed on the inner end 70 of the adjustment arm 62, and an annular mating area 159 formed on the outer end 72 of the extension arms 74, fit together when the first end 72 of the extension arm 74 is retained to the second end 70 of the adjustment arm 62 by the bolt 157. Each mating area 158 and 159 is formed with radially-extending grooves and teeth which fit or mesh together in a complementary manner to establish a rigid pivotal orientation of the adjustment arm 62 relative to the extension arm 74, when the bolt 157 is tightened. The radially extending grooves and teeth prevent the arms 62 and 74 from pivoting relative to one another when the bolt 157 is tightened.

A bushing 160 extends from the outer end 72 of the extension arm 74. The bushing 160 is press fit into a cylindrical opening 161 in the end 72 of the extension arm 74. The bushing 160 is located concentrically radially inward from the mating area 158 on the extension arm 74. The bushing 160 has a center opening 162 formed through it to receive the bolt 157 when the ends 70 and 72 of the arms 62 and 74 are connected together. The length of the bushing 160 is greater than the thickness of the end 72 of the extension arm 74 at the cylindrical opening 161, thereby projecting a lower portion 164 of the bushing 160 into a annular recess 166 in the second end 70 of the adjustment arm 62, when the two ends 70 and 72 are connected. The annular recess 166 is located concentrically radially inward from the mating area 158 on the adjustment arm 62. The outside diameter of the bushing 160 creates a very close tolerance with the inside diameter of the annular recess 166, thereby eliminating any significant play or looseness when the arms 62 and 74 are connected. Any torque between the arms 62 and 74 is absorbed by the bushing 160, thereby relieving the bolt 157 from assuming this load, in a similar manner to the bushing 130 absorbing any torque between the arm 62 and the receiver block 114, as described above (FIGS. 8-10).

The bolt 157 extends through an opening 168 formed in the outer end 70 of the adjustment arm 62 at a location inward of and concentric with the annular recess 166. Internal threads are formed within the opening 168. The bolt 157 screws into the internal threads within the opening 168 to hold the ends 70 and 72 of the arms 62 and 74 together.

A linear compression coiled spring 170 surrounds the bolt 157 within the center opening 162 in the bushing 160. The spring 170 is compressed between the ends 70 and 72 of the arms 62 and 74 when the bolt 157 is tightened. The compression force from the spring 170 is insufficient to prevent the radial grooves and teeth of the annular mating areas 158 and 159 from engaging one another when the bolt 157 is tightened. However, when the bolt 157 is loosened, the spring 170 induces a separation force between the annular mating areas 158 and 159 along the axis of the bolt 157, thereby separating the grooves and teeth of the annular mating areas 158 and 159 from one another by a sufficient distance to allow pivotal movement of the arms 62 and 74 relative to one another at the ends 70 and 72 of the arms 62 and 74.

The disengagement of the radial grooves and teeth in the annular mating areas 158 and 159 created by the spring 170 (FIG. 12) allows the user to easily adjust the desired angle between the arms 62 and 74. On the other hand, the compression force of the spring 170 between the ends 70 and 72 of the arms 62 and 74 is sufficient to hold the arms 62 and 74 in a desired adjusted angular orientation when the annular mating areas 158 and 159 are separated, without disconnecting the arms 62 and 70 from one another. Consequently, the desired adjustment angle between the arms 62 and 74 is maintained without tightening the bolt 157 until it is desired to do so when the other desired adjustment positions have been achieved, at which point the bolt 157 is tightened to engage the mating areas 158 and 159 and to fix the desired pivoted angular relationship between the arms 62 and 74. The freely pivotal connection of the outer ends 64 of the adjustment arms 62 to the receiver blocks 114 facilitates establishing the desired adjustment positions by tightening the single bolt 157 between the each extension arm 74 and adjustment arm 62.

Figure 13:
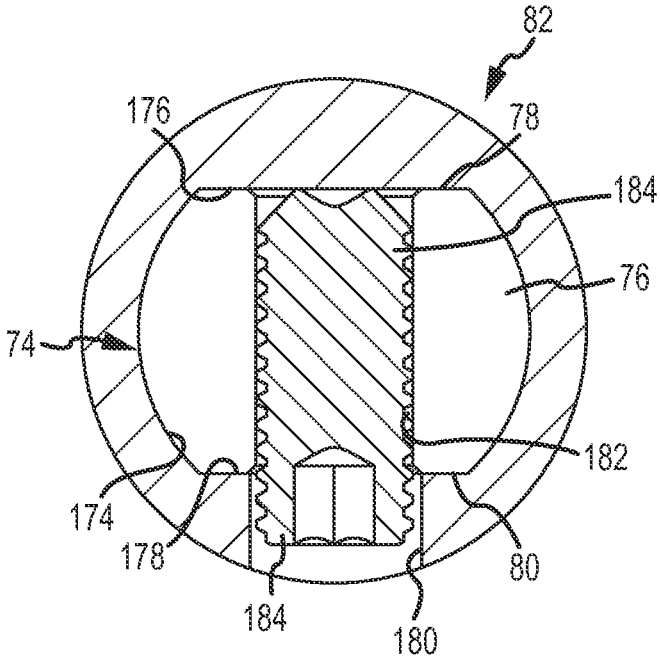
FIG. 13 is a transverse cross-sectional view of an extension arm of the back support assembly shown in FIGS. 4, 5, 11 and 12, inserted within a connecting tube of the back support assembly.
Figure 14:
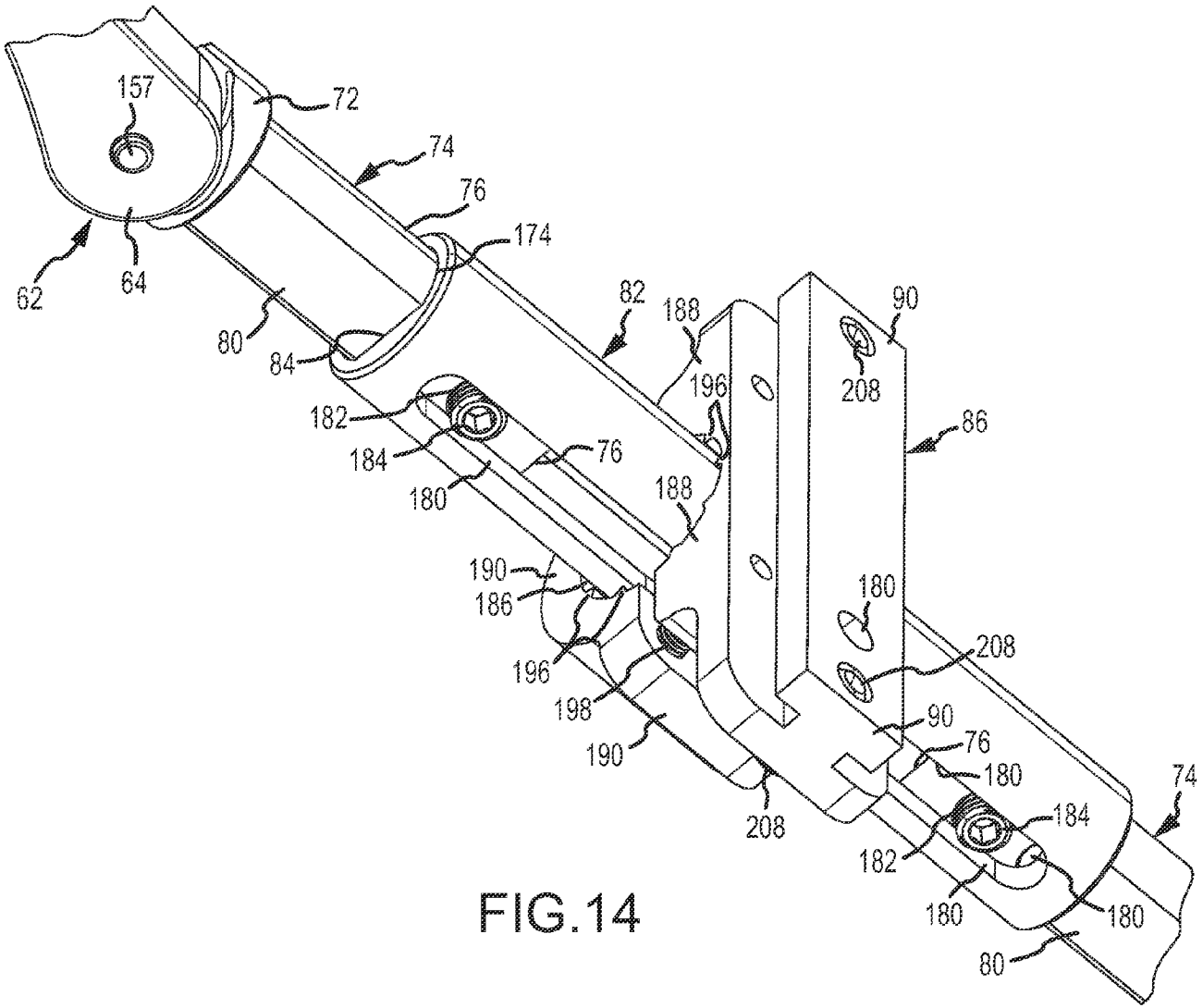
FIG. 14 is a perspective view of the connecting tube shown in FIG. 13, a portion of the extension arms shown in FIGS. 11 and 12, and a back retaining clamp shown in FIGS. 4 and 5 connected to the connecting tube, viewed from a perspective below the connecting tube to illustrate slots formed in the connecting tube and set screws in the slots connected to the extension arms.

The two flat, parallel extending surfaces 78 and 80 of the second, inner end 76 of each extension arm 74 are located diametrically opposite from one another, as shown in FIGS. 5 and 13. The resulting cross-sectional configuration is that of a parallel-segmented circle, also called a double-D shaped cross-section. The double-D cross-sectionally shaped inner ends 76 of the extension arms 74 extend into opposite ends of a hollow connecting tube 82 (FIGS. 4, 5 and 14). A center opening 174 of the hollow connecting tube 82 has a cross-sectional configuration of the same complementary cross-sectional shape as the double-D shaped inner ends 76 of the extension arms 74, as shown in FIG. 13. Two inward facing flat parallel surfaces 176 and 178 of the center opening 174 extend parallel to one another on opposite sides of the center opening 174. The flat surfaces 176 and 178 adjoin the flat parallel surfaces 78 and 80 of the double-D shaped ends 72 of the extension arms 74, respectively, when the ends 72 extend into the center opening 174. A slight clearance between the center opening 174 and the complementary shaped ends 76 of the extension arms 74 allows the ends 76 to move freely in a telescopic manner within the center opening 174 of the connecting tube 82. The clearance is not so great to create excessive looseness between the extension arms 74 and the connecting tube 82.

An elongated slot 180 extends along the bottom and through the connecting tube 82 into the flat surface 178. Two spaced-apart internally threaded holes 182 extend through each end 76 of each extension arms 74. A set screw 184 extends through each elongated slot 180 in the connecting tube 82 and threads into one hole 182 of the aligned end 76 of each extension arm 74 (FIG. 14). Tightening the set screw 184 causes its upper end (FIG. 13) to extend beyond the upper flat surface 78 and to press against the flat surface 176 of the connecting tube 82. The force from the set screw 184 prevents the connecting tube 82 and the extension arm 74 from moving telescopically with respect to one another. When the set screws 184 are not tightened, the rear ends of the set screws extend into the elongated slots 180 to prevent the extension arms 74 from separating from the connecting tube 82, while permitting telescopic movement. The set screws 184 can be tightened only enough to create resistance or drag in the telescopic movement of the extension arms 74 with respect to the connecting tube 82, when the position of the back support assembly is adjusted. Thereafter, once the desired position is established, the set screws 184 are tightened more firmly to retain the extension arms 74 rigidly relative to the connecting tube 82.

The back retaining clamp 86 is attached to the connecting tube 82 by inserting the connecting tube into a generally circular shaped opening 186 which is formed into a structural block 188 and a cap member 190 of the back retaining clamp 86, as shown in FIGS. 4, 5, 14 and 15. The circular opening 186 is defined in part by the structural block 188 and in the other part by the cap member 190. Free ends 192 of the cap member 188 are separated by gaps 194 from the structural block 188. Ribs or teeth 196 extend inward from the circumference of the circular opening 186 on both the structural block 188 and the cap member 190. The teeth 196 constrict against and indent slightly into the connecting tube 82 when the free end 192 of the cap member 190 is drawn toward the structural block 188 by tightening bolts 198. The bolts 198 extend through holes 200 in the free ends 192 of the cap member 190 into internally threaded holes 202 formed in the block 188. Tightening the bolts 198 draws the free end 192 of the cap member 190 toward the structural block 188, thereby diminishing the width of the gaps 194 and compressing the teeth 186 against, and slightly indenting the teeth 186 into, the outside surface of the connecting tube 82.

Attaching the back retaining clamp 86 to the connecting tube 82 in the described manner prevents the back retaining clamp 88 from rotating relative to the connecting tube 82. The rotational position of the seat back 38 and back cushion 40 (FIG. 4) about the transverse axis 50 (FIG. 2) is established by the orientation of the back retaining clamp 86 on the connecting tube 82.

Figure 15:
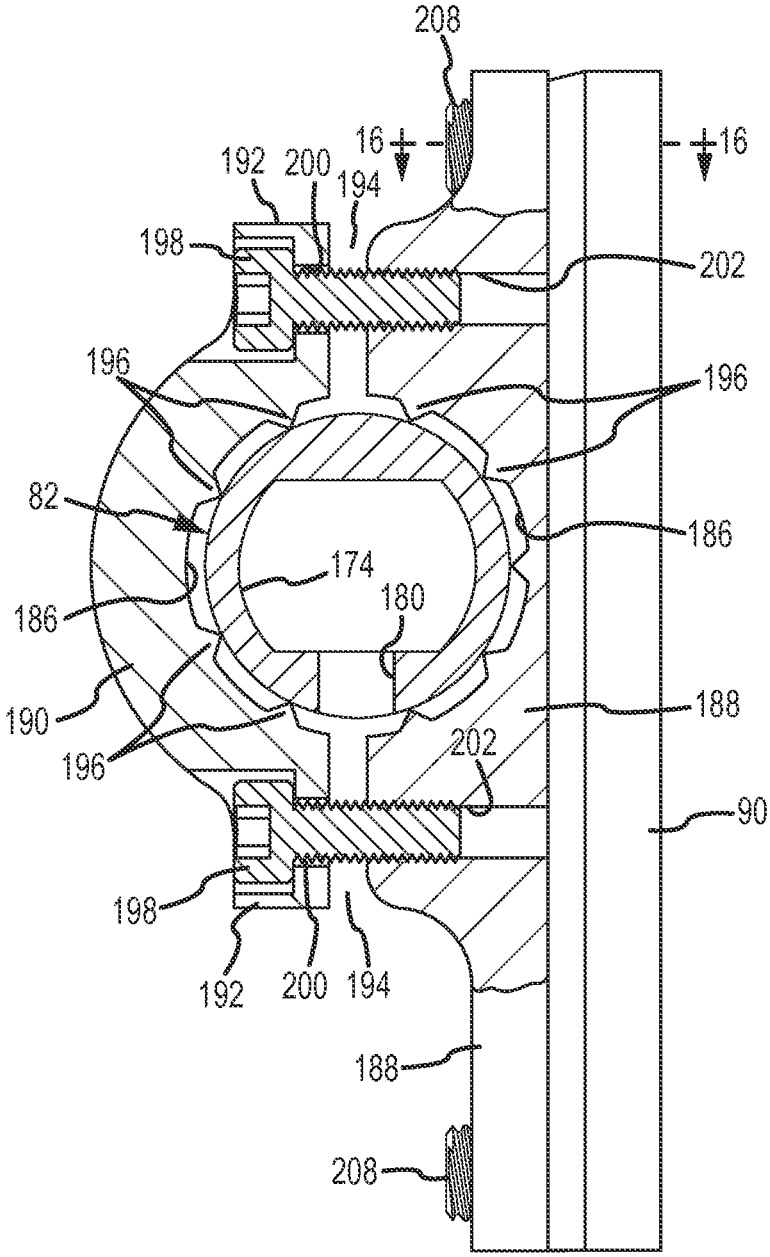
FIG. 15 is a partially-sectioned side elevation view of the back retaining clamp connected to the connecting tube shown in FIG. 14.

The T-shaped bar portion 90 of the back retaining clamp 86 is formed into the structural block 188, as shown in FIGS. 15 and 16. The T-shaped bar portion 90 extends generally vertically at a forward location on the structural block 188. Alternatively, the T-shaped bar portion 90 could be formed separately from the structural block 188, and then attached to the structural block 188 in a conventional manner.

Figure 17:
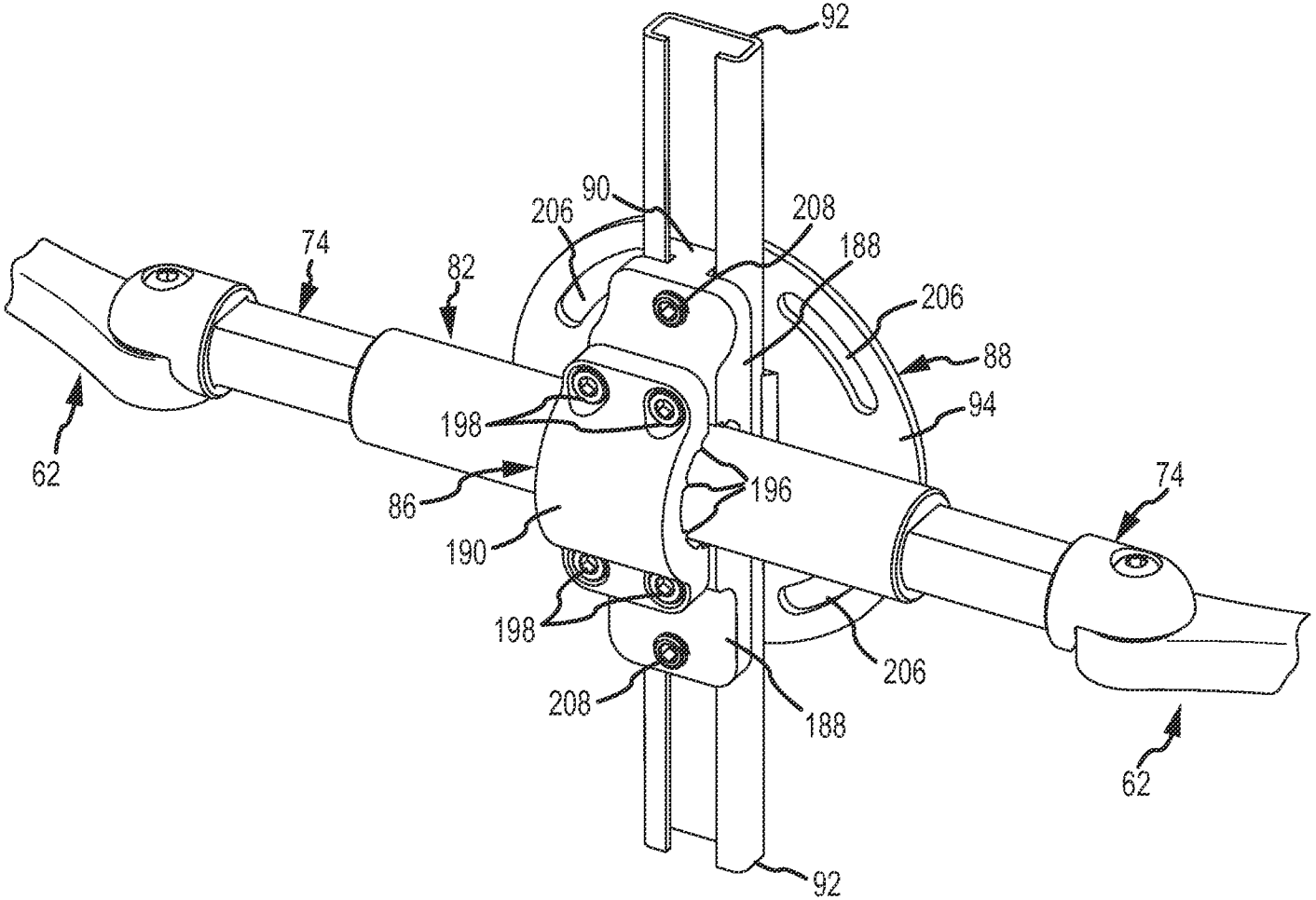
FIG. 17 is a perspective view of the back retaining clamp and the back shell connector shown in FIG. 16, in assembled relationship and connected to the connecting tube of the back support assembly.

The back retaining clamp 86 is connected to the back shell connector 88 by positioning the T-shaped bar portion 90 into the C-shaped channel 92 of the back shell connector 88, as shown in FIGS. 16 and 17. The C-shaped channel 92 is attached to a circular plate 94 of the back shell connector 88, such as by welding for example. The circular plate 94 is attached to the back shell 38 by screws 204 which extend through arcuate slots 206 formed in the circular plate 94, as shown in FIG. 17. The arcuate slots 206 allow the back shell 38 to rotate relative to the circular plate 94, thereby achieving rotation of the back shell 38 and the back cushion 40 about the longitudinal axis 48 (FIG. 2). Once the desired position of the back shell 38 is achieved, the screws 204 are tightened to hold the back shell 38 in the desired position relative to the circular plate 94.

The back shell connector 88 is retained in position to the back retaining clamp 86 by set screws 208 which are threaded through threaded holes 210 located at opposite vertical ends of the T-shaped bar portion 90, as shown in FIGS. 16 and 17. The set screws 208 extend forward (FIG. 16) and press against the C-shaped channel 92. The pressure from the set screws 208 against the C-shaped channel 92 fixes the position of the C-shaped channel 92 relative to the T-shaped bar portion 90, and thereby fixes the position of the back shell connector 88 relative to the back retaining clamp 86 to establish the vertical position of the back shell 38 and back cushion 40 relative to the seat cushion 42 (FIGS. 1 and 2). Until the desired height is achieved, the amount of extension of the set screws 208 beyond the T-shaped bar portion 90 is only so much as to create enough resistance or drag against the C-shaped channel 92 to allow vertical adjustment of the shell 38 and cushion 40. Once the desired position is achieved, the set screws 208 are tightened.

The back support assembly 30 allows a physical therapist or wheelchair seating professional to fit the back cushion 40 to a user 46 while in the wheelchair. A desired support and gravity position of the user 46 in the wheelchair 36 is established in a much more convenient, safe, and efficient way than has previously been possible.

The back cushion 40 is adjusted in position by loosening the bolts 157 which connect the ends 70 and 72 of the arms 62 and 74 and loosening the set screws 184 which connect the end 76 of the extension arms 74 to the connecting tube 82. Loosening the bolts 157 causes the spring 170 to disengage the groove and tooth annular mating areas 158 and 159 from one another, freeing the ends 70 and 72 of the arms 62 and 74 and allowing the arms 62 and 74 to pivot relative to one another. Loosening the set screws 184 allows the ends 76 of the extension arms 74 to longitudinally slide relative to one another within the connecting tube 82. The conically shaped bushings 130 allow the adjustment arms 62 to pivot relative to the receiver blocks 34.

In this loosened configuration, the back shell 38 is moved forward and backward along the longitudinal horizontal axis 48 by the pivoting movement of the arms 62 and 74 relative to one another while the ends 76 of the extension arms 74 telescope within the connecting tube 82. Pivoting the adjustment arms 62 rearward locates the back shell 38 and back cushion 40 in a rear position, as shown in FIG. 18A. Pivoting the adjustment arms 62 to point more transversely toward one another moves the shell 38 and cushion 40 forward to an intermediate forward and rearward position, as shown in FIG. 18B. Pivoting the adjustment arms 62 forward locates the shell 38 and cushion 40 in a forward position, as shown in FIG. 18C. If an even greater forward position of the shell 38 and cushion 40 is desired, the mounting devices 60 can be reconnected or rotated around the canes to extend forward from the canes 32, as shown in FIG. 18D. The pivoting movement of the adjustment arms 62 allows the shell 38 and cushion 40 to be positioned behind, between or in front of the canes 32, which is a capability that most prior art devices lack altogether. Many such prior art devices require the shell 38 and cushion 40 to be positioned only in front of the canes 32. Once the desired position of the shell 38 and cushion 40 is achieved, the bolts 157 and the set screws 184 are tightened to retain this position.

The back shell 38 and cushion 40 are adjusted rotationally about the forward and backward longitudinal axis 48, as shown in FIGS. 19A and 19B, by loosening the screws 204 which connect the circular plate 94 to the back shell 38, and thereafter rotating the back shell 38 relative to the circular plate 94 while the screws 204 move within the arcuate slots 206. Once the desired rotational position along the longitudinal axis 48, is achieved, the screws 204 are tightened to hold the circular plate 94 firmly against the back shell 38.

The back cushion 40 is adjusted laterally about the transverse axis 50, as shown in FIGS. 20A and 20B, by moving the position the connecting tube 82 along the ends 76 of the extension arms 74. The set screws 184 are loosened to allow the connecting tube 82 to move laterally along the ends 76 of the extension arms 74. Once the desired position is achieved, the set screws 184 are tightened to hold this position. Alternatively, lateral side to side movement along the horizontal transverse axis 50 is also achieved by adjusting the position of the back retaining clamp 86 along the length of the connecting tube 82, as shown in FIG. 20C. The bolts 198 are loosened sufficiently to move the cap member 190 away from the structural block 188 enough so that the teeth 196 of the circular opening 86 move away from outside surface of the connecting tube 82. In this condition, the position of the back retaining clamp 86 is adjusted from side to side along the connecting tube 82 until the desired position is achieved. Thereafter the bolts 198 are tightened to retain the desired transverse position of the back shell 38 and cushion 40.

The back cushion 40 is adjusted pivotally about the transverse axis 50, as shown in FIGS. 21A and 21B, by adjusting the rotational position of the back retaining clamp 86 on the connecting tube 82. This is accomplished by loosening the bolts 198 sufficiently to allow the cap member 190 and the structural block 188 to separate enough so that the teeth 196 of the circular opening 186 move away from the outside surface of the connecting tube 82. In this condition, the position of the back retaining clamp 86 can be pivoted about the connecting tube 82 until the desired position is achieved. Thereafter the bolts 198 are tightened to retain the desired rotational position of the back shell 38 and cushion 40.

Figure 22A:
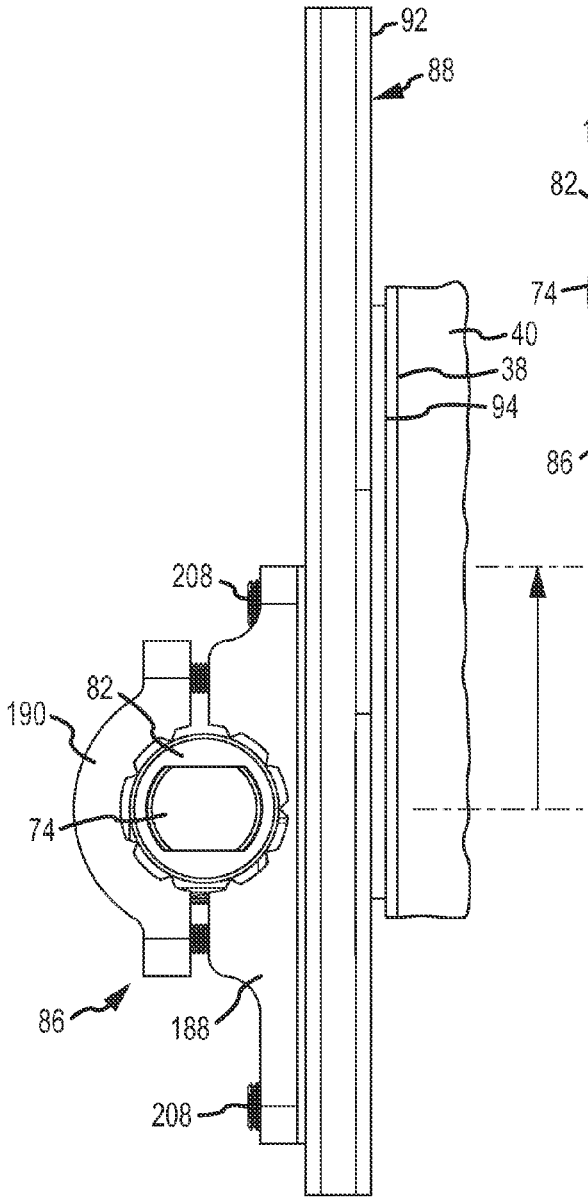
FIGS. 22A and 22B are generalized side elevation of views illustrating the range of vertical adjustment of the back support assembly shown in FIGS. 4 and 5, along the vertical axis shown in FIG. 2.
Figure 22B:
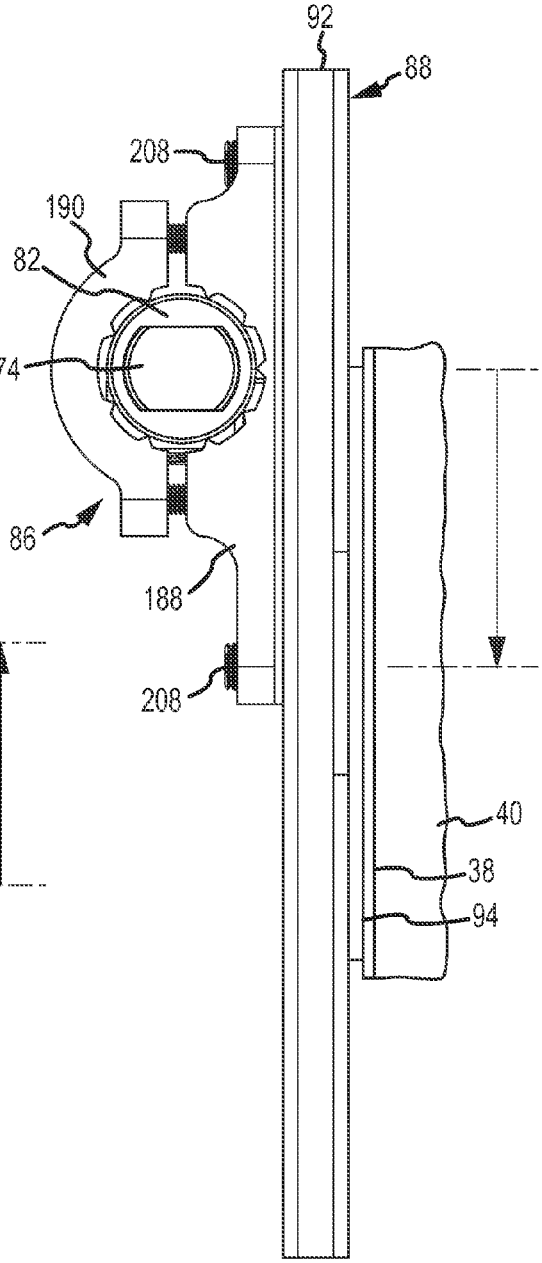

The back cushion 40 is adjusted vertically about the vertical axis 52, as shown in FIGS. 22A and 22B, by loosening the set screws 208 in the back retaining clamp 86 to allow the C-shaped channel member 92 to move relative to the T-shaped bar portion 90. In this condition, the position of the back shell connector 88 can be moved vertically relative to the back retaining clamp 86 until the desired vertical position of the back shell 38 and back cushion 40 is achieved relative to the seat cushion 42 (FIGS. 1-3). Thereafter the set screws 208 are tightened to retain the C-shaped channel member 92 relative to the T-shaped bar portion 90 and establish the vertical position of the shell 38 and cushion 40.

The back cushion 40 is rotated vertically about the vertical axis 52, as shown in FIGS. 23A and 23B, by adjusting the transverse angular orientation of the connecting tube 82. This is accomplished by loosening the bolts 157 which connect the ends 70 and 72 of the arms 62 and 74 and loosening the set screws 184 which connect the ends 76 of the extension arms 74 to the connecting tube 82. Loosening the bolts 157 causes the spring 170 to separate the groove and tooth annular mating areas 158 and 159 from one another, freeing the ends 70 and 72 of the arms 62 and 74 and allowing the arms 62 and 74 to pivot relative to one another. Loosening the set screws 184 allows the ends 76 of the extension arms 74 to longitudinally slide relative to one another within the connecting tube 82. The conically shaped bushings 130 allow the adjustment arms 62 to pivot relative to the receiver blocks 114.

In this loosened configuration, the arms 62 and 74 on one transverse side of the wheelchair frame 34 are pivoted forward or backward to a greater degree than the arms 62 and 74 are pivoted forward or backward on the opposite side of the wheelchair frame 34. The ends 76 of the extension arms 74 are telescoped into and out of the connecting tube 82 to accommodate pivoting of the arms 62 and 74. The different degree of forward or backward pivoting of the arms 62 and 74 causes the back shell 38 to rotate clockwise (FIG. 23A) and counterclockwise (FIG. 23B) about the vertical axis 52. Once the desired rotational position of the shell 38 and cushion 40 is achieved, the bolts 157 and the set screws 184 are tightened to retain this position.

Thus in the manner described, longitudinal and rotational positioning in and about all three mutually perpendicular axes is achieved, by loosening retaining bolts and screws without disassembling any components of the support assembly 30 and risking loss or misplacement or disassembly of the components. Adjustment and positioning in all three mutually perpendicular axes is accomplished while the entire back support assembly 30 remains fully connected together, thereby allowing the therapist and wheelchair seating professional to achieve the most desirable, healthy and safe position for the wheelchair user. No additional actions are required other than to position the back shell 38 and cushion 40 relative to the upper torso of the wheelchair user. Once the desired position is achieved, that desired position is firmly retained by tightening the retaining bolts and screws while the desired position is maintained, without assembling or adding parts to fix the desired position. Enough resistance or drag between the movable elements of the back support assembly 30 allows those elements to stay in a coarse position until the bolts and screws are tightened. If fine adjustment in position are thereafter desired, each fine adjustment can be achieved independently about the three axes by adjusting only that portion of the back support assembly 30 which accomplishes the desired adjustment, as described in connection with FIGS. 18A-23B, without adversely influencing the other adjusted positions. Considerable convenience in obtaining the proper back shell alignment is achieved, along with better positioning and support of the wheelchair user.

Many other advantages, improvements and benefits will be more apparent upon gaining a complete appreciation for the present invention. Preferred embodiments of the invention and many of its improvements have been described with a degree of particularity. This detailed description is of a presently preferred example of implementing the invention. The scope of the invention is defined by the following claims.

The invention claimed:

1. A back support assembly for connection to transversely spaced apart canes of a wheelchair by which to support a back shell and back cushion against which a back and upper torso of a user of the wheelchair is positioned, comprising:

a pair of mounting devices, each mounting device adapted for connection to a cane of the wheelchair;

a pair of adjustment arms each having first and second opposite ends, the first ends of the adjustment arms connected respectively to the mounting devices to pivot with respect to the mounting devices;

a pair of extension arms each having first and second opposite ends, the first ends of the extension arms connected respectively to the second ends of the adjustment arms to selectively pivot the extension arms relative to the adjustment arms and to rigidly maintain a selective pivot position of each extension arm relative to the connected adjustment arm, the second end of each extension arm having a predetermined cross-sectional configuration;

a connecting structure having opposite hollow ends with openings into which the second ends of the extension arms are respectively inserted to telescope relative to the connecting structure, the opening having a complementary predetermined cross-sectional configuration corresponding to the predetermined cross-sectional configuration of the second end of each extension arm which is inserted into that opening;

a back retaining clamp connected to the connecting structure to pivot selectively about the connecting structure; and a back shell connector connected to the back retaining clamp to move selectively vertically relative to the connecting structure, the back shell connector also adapted to connect to the back shell in a selected rotational position relative to the connecting structure.

2. A back support assembly as defined in claim 1, wherein:

the connection of the first ends of the adjustment arms to the mounting devices maintains the adjustment arms freely pivotal relative to the mounting devices.

3. A back support assembly as defined in claim 1, wherein:

each mounting device comprises a receiver block having a receiver opening formed therein;

the first end of the adjustment arm includes a bushing extending therefrom into the receiver opening;

a fastener extends between the first end of the adjustment arm and the receiver block to maintain the bushing within the receiver opening; and the bushing transfers substantially all torsional force between the adjustment arm and the mounting block independently of the fastener.

4. A back support assembly as defined in claim 3, wherein:

the bushing includes a conically-shaped tapered portion which extends away from the first end of the adjustment arm; and the receiver opening includes a conically-shaped portion which is complementary to the tapered portion of the bushing and which receives therein the tapered portion of the bushing.

5. A back support assembly as defined in claim 3, wherein:

the fastener comprises a quick release pin which is rigidly connected to the first end of the adjustment arm.

6. A back support assembly as defined in claim 1, wherein:

the connection of the first end of each extension arm to the second end of each adjustment arm comprises a bushing extending from one of the first end of the extension arm or the second end of the adjustment arm, and an annular recess formed in the other one of the first end of the extension arm or the second end of the adjustment arm, the annular recess receiving the bushing therein; and a fastener extending between the second end of the adjustment arm and the first end of the extension arm to apply fastening force to draw the second end of the adjustment arm and the first end of the extension arm into contact with one another to rigidly maintain the selective relative pivoted position of the extension arm and the connected adjustment arm; and the bushing transferring torsional force between the adjustment arm and the extension arm.

7. A back support assembly as defined in claim 6, wherein:

the first end of each extension arm and the second end of each adjustment arm each include complementary mating areas which contact each other to maintain the selective relative pivoted position of the extension arm and the connected adjustment arm, the mating areas each include complementary structures which fit and engage together to prevent the relative rotation and maintain the selective relative pivoted position.

8. A back support assembly as defined in claim 7, wherein:

each complementary mating area is annularly shaped;

one annular shaped mating area circumscribes the bushing extending from the one of the first end of the extension arm or the second end of the adjustment arm;

the other annular shaped mating area circumscribes the annular recess formed in the other one of the first end of the extension arm or the second end of the adjustment arm; and the fastener comprises a bolt which extends between the second end of the adjustment arm and the first end of the extension arm at a position which is coaxial with the bushing and the annular recess and the mating areas, the bolt applying selective fasting force for holding the complementary mating areas in engagement with one another.

9. A back support assembly as defined in claim 8, wherein:

the connection of the first end of each extension arm to the second end of each adjustment arm further comprises a spring positioned to apply separation force in opposition to the fastening force from the fastener, the separation force from the spring separating the mating areas of first end of each extension arm and the second end of each adjustment arm from engagement with one another upon relieving the fastening force from the bolt.

10. A back support assembly as defined in claim 9, wherein:

the separation of the complementary structures of the mating areas is sufficient to disengage the complementary structures and allow for relative pivoting movement of the extension arm relative to the adjustment arm while the bushing remains in the annular recess.

11. A back support assembly defined in claim 10, wherein:

the complementary structures of the complementary mating areas which engage to prevent relative rotation and maintain the selective relative pivoted position comprise radially extending teeth and grooves.

12. A back support assembly as defined in claim 1, wherein:

a fastener extends between the second end of the adjustment arm and the first end of the extension arm to apply fastening force to draw the second end of the adjustment arm and the first end of the extension arm into engagement with one another; and the connection of the first end of each extension arm to the second end of each adjustment arm comprises complementary mating areas formed on the first end of the extension arm and on the second end of the adjustment arm, the complementary mating areas each include complementary structures which engage and fit together to prevent the relative rotation and maintain the selective relative pivoted position of the extension arm and the adjustment arm upon the fastener drawing the complementary structures of second end of the adjustment arm into engagement with the complementary structures of the first end of the extension arm.

13. A back support assembly as defined in claim 12, wherein:

the connection of the first end of each extension arm to the second end of each adjustment arm further comprises a spring positioned to apply separation force in opposition to the fastening force from the fastener, the separation force from the spring separating the mating area of first end of the extension arm from the mating area of the second end of the adjustment arm upon relieving the fastening force from the fastener, the separation of the mating areas permitting relative pivoting movement of the extension arm relative to the adjustment arm while the fastener remains connected between the first end of the extension arm and the second end of the adjustment arm.

14. A back support assembly as defined in claim 1, wherein:

the connecting structure is defined by a connecting tube;

the complementary predetermined cross-sectional configurations of the opening in the connecting tube and the second end of each extension arm each include a flat surface which adjoins a flat surface of the other complementary cross-sectional configuration, the adjoining flat surfaces preventing relative rotation of the connecting tube relative to the second ends of the extension arms.

15. A back support assembly as defined in claim 14, wherein:

the second end of each extension arm includes a fastener operative to extend therethrough and contact the complementary cross-sectional configuration of the connecting tube to apply contact force to fix the relative positions of the second end of the extension arm in the connecting tube and prevent relative telescoping movement of the second end of the extension arm and the connecting tube.

16. A back support assembly as defined in claim 15, wherein:

the connecting tube defines a slot which extends parallel to the second end of the extension arm and which receives the fastener therein, the fastener preventing relative separation of the second end of the extension arm from the connecting tube when the contact force from the fastener is relieved to permit relative telescoping movement of the second end of the extension arm and the connecting tube.

17. A back support assembly as defined in claim 1, wherein:

one of the second end of the extension arm or the connecting structure includes a retainer which extends between the extension arm and the connecting structure to prevent separation of the second end of the extension arm from the connecting structure during relative telescoping movement of the second end of the extension arm and the connecting structure.

18. A back support assembly as defined in claim 1, wherein:

the connecting structure is defined by a connecting tube;

the complementary predetermined cross-sectional configurations of the opening in the connecting tube and the second end of each extension arm prevent rotation of the connecting tube relative to the second ends of the extension arms; and the back retaining clamp comprises a structural block and a cap connected to the structural block to collectively define an opening into which the connecting tube is received, the cap is selectively connectable in position to the structural block to apply to a constriction force on the connecting structure at the opening to retain the back retaining clamp at a desired pivoted position relative to the connecting tube.

19. A back support assembly as defined in claim 18, wherein:

the back retaining clamp includes a T-shaped bar portion;

the back shell connector includes a C-shaped channel portion; and the T-shaped bar portion is located within the C-shaped channel portion and is movable therealong to achieve relative longitudinal movement of the back shell connector relative to the back retaining clamp along the extension of the T-shaped bar portion and the C-shaped channel portion.

20. A back support assembly as defined in claim 19, wherein:

a fastener is operative to apply retaining force between the T-shaped bar portion and the C-shaped channel portion to prevent relative longitudinal movement of the back shell connector relative to the back retaining clamp.

21. A back support assembly as defined in claim 1, wherein:

the back shell connector includes a plate and a longitudinal connection portion which movably connects to the back retaining clamp to move the back shell connector along the longitudinal connection portion.

22. A back support assembly as defined in claim 1, wherein:

the back shell connector includes a plate adapted to be connected to the back shell, the plate including annular slots formed therein to receive fasteners extending between the plate and the back shell, the annular slots permitting attachment of the back shell to the back shell connector in a selectively pivoted position.

23. A back support assembly as defined in claim 1, wherein:

each mounting device comprises a receiver block and a clamp;

the clamp includes a retention bracket connected to the receiver block and an attachment bracket pivotally connected to the retention bracket to pivot the attachment bracket relative to the retention bracket, the attachment bracket and the retention bracket defining an opening between the attachment bracket and the retention bracket within which to receive the cane; and the clamp further including a fastener extending between the attachment bracket and the retention bracket to force the attachment bracket toward the retention bracket and to constrict the opening around the cane, the fastener remaining connected to one of the attachment bracket or the retention bracket and selectively detaching from the other one of the attachment bracket or the retention bracket.

24. A back support assembly as defined in claim 23, wherein:

the fastener comprises an elongated bolt having threads at one end and a head at another end;

the clamp further includes a barrel nut into which the bolt is threadably connected at the one of the attachment bracket or the retention bracket; and the other one of the attachment bracket or the retention bracket includes a slot into which the head of the bolt is selectively positioned when the attachment bracket is forced toward the retention bracket and from which the head of the bolt is selectively removed to selectively detach the bolt from the other one of the attachment bracket or the retention bracket.

25. A method of supporting a back and upper torso of a wheelchair user along and about three mutually perpendicular longitudinal, transverse and vertical axes by a back cushion connected to a back shell connected to a wheelchair having a frame, comprising:

operatively and pivotally connecting first ends of two elongated adjustment arms on respectively opposite transverse sides of the wheelchair frame;

pivotally connecting first ends of elongated extension arms to second ends of the adjustment arms;

telescopically extending second ends of the extension arms into opposite ends of a connecting structure;

operatively attaching the back shell to the connecting structure;

adjusting the longitudinal position of the back cushion along the longitudinal axis and adjusting the pivotal position of the back cushion about the vertical axis by selectively establishing and fixing pivoted positions of the adjustment and extension arms relative to one another;

adjusting the transverse position of the back cushion along the transverse axis by one of telescopically moving the connecting structure relative to the second ends of the extension arms or by positioning the back shell at a selected transverse position along the connecting structure;

adjusting the pivoted position of the back cushion about the transverse axis by selectively pivoting the back shell about the transverse axis relative to the connecting structure at the operative attachment of the back shell to the connecting structure;

adjusting the vertical position of the back cushion along the vertical axis by selectively positioning the back shell at a selected position along the vertical axis relative to the connecting structure at the operative attachment of the back shell to the connecting structure;

adjusting the pivoted position of the back cushion about the longitudinal axis by selectively pivoting the position the back shell about the longitudinal axis at the operative attachment of the back shell to the connecting structure; and performing all of the aforesaid adjustments while the first ends of the adjustment arms remain operatively pivotally connected to the canes and while the second ends of the extension arms are retained in the connecting structure.

26. A method as defined in claim 25, further comprising:

maintaining the pivoted positions of the extension arms and the connected adjustment arms by contacting the second ends of the adjustment arms and the first ends of the extension arms with one another.

27. A method as defined in claim 25, further comprising:

maintaining the pivoted positions of the extension arms and the adjustment arms by contacting complementary mating structures which fit and engage together on the first ends of the extension arms and on the second ends of the adjustment arms.

28. A method as defined in claim 27, further comprising:

contacting the complementary mating structures on the second ends of the adjustment arms and the first ends of the extension arms by applying fastening force between the second ends of the adjustment arms and the first ends of the extension arms with a fastener.

29. A method as defined in claim 28, further comprising:

transferring torsional force between the adjustment arms and the extension arms through bushings which extend between the first ends of the extension arms and the second ends of the adjustment arms.

30. A method as defined in claim 28, further comprising:

applying separation force between the first ends of the extension arms and the second ends of the adjustment arms in opposition to the fastening force from the fastener to separate the complementary mating structures of first ends of the extension arms and the second ends of the adjustment arms from engagement with one another upon relieving the fastening force from the fastener.

31. A method as defined in claim 27, further comprising:

separating the complementary mating structures sufficiently to disengage the complementary structures to allow adjusting the pivoted positions of the extension arms and the adjustment arms.

32. A method as defined in claim 25, further comprising:

preventing relative rotation of the connecting structure relative to the second ends of the extension arms by engaging an opening of predetermined cross-sectional configuration in the connecting structure with a complementary cross-sectional configuration of the second end of each extension arm.

33. A method as defined in claim 25, further comprising:

preventing relative telescoping movement of the second ends of the extension arms and the connecting structure by selectively applying contact force between the second ends of the extension arms and the connecting structure to fix the relative positions of the second ends of the extension arms in the connecting structure.

34. A method as defined in claim 25, further comprising:

preventing separation of the second ends of the extension arms from the connecting structure during relative telescoping movement of the second ends of the extension arms and the connecting structure.

35. A method as defined in claim 25, further comprising:

retaining the back shell to the connecting structure with a back shell connector; and orienting the back shell connector at a desired pivoted position relative to the connecting structure by applying a constriction force on the connecting structure from the back shell connector.

36. A method as defined in claim 25, further comprising:

selectively pivoting the position of the back shell about the longitudinal axis by attaching a back shell connector to the back shell in the selectively pivoted position.

37. A method as defined in claim 25, further comprising:

maintaining a freely pivotal connection of the first ends of the adjustment arms to the opposite sides of the wheelchair frame; and preventing relative pivoting movement of the adjustment arms relative to the wheelchair frame by maintaining the pivoted positions of the extension arms relative to the adjustment arms.

* * * * *